US008394217B2

(12) United States Patent
Pien

(10) Patent No.: US 8,394,217 B2
(45) Date of Patent: Mar. 12, 2013

(54) METHOD AND APPARATUS FOR FLOOR PLANKS

(75) Inventor: Chao Kang Pien, Edison, NJ (US)

(73) Assignee: Advance Vinyl Floor Manufacturing Corp., Edison, NJ (US)

( * ) Notice: Subject to any disclaimer, the term of this patent is extended or adjusted under 35 U.S.C. 154(b) by 75 days.

(21) Appl. No.: 13/044,587

(22) Filed: Mar. 10, 2011

(65) Prior Publication Data

US 2011/0265409 A1 Nov. 3, 2011

Related U.S. Application Data

(63) Continuation-in-part of application No. 12/769,736, filed on Apr. 29, 2010, now Pat. No. 8,268,110, and a continuation-in-part of application No. 12/950,546, filed on Nov. 19, 2010.

(51) Int. Cl.
*E04B 2/00* (2006.01)
*E04F 13/00* (2006.01)

(52) U.S. Cl. ..... 156/71; 156/304.5; 156/182; 156/257; 156/268; 52/578; 52/588.1

(58) Field of Classification Search ..... 156/304.5, 156/249, 196, 182, 268, 257, 258, 263, 254, 156/71; 52/578, 588.1
See application file for complete search history.

(56) References Cited

U.S. PATENT DOCUMENTS 2,932,596 A * 4/1960 Rayner ..... 428/215
2010/0281810 A1* 11/2010 Ruland ..... 52/588.1

FOREIGN PATENT DOCUMENTS

JP 02000328759 A * 11/2000

* cited by examiner

*Primary Examiner* — Linda L Gray
(74) *Attorney, Agent, or Firm* — Walter J. Tencza, Jr.

(57) ABSTRACT

A floor plank having a wear layer, a pattern film, and a magnetic base layer. The floor plank may have a length, a width, and a thickness, wherein the length and the width are substantially larger than the thickness. The magnetic base layer may have a magnetic field which is in a direction substantially parallel to a plane defined by the length and the width of the floor plank, and wherein the direction of the magnetic field is substantially perpendicular to the thickness of the floor plank. The floor plank and an identical floor plank may be placed on the subfloor so that the two floor planks are adjacent one another and so that a magnetic pole of a magnetic base layer of one floor plank is attracted to an opposite magnetic pole of a magnetic base layer of the other floor plank to thereby connect the two floor planks.

12 Claims, 22 Drawing Sheets

METHOD AND APPARATUS FOR FLOOR PLANKS

CROSS REFERENCE TO RELATED APPLICATION(S)

The present application is a continuation in part of and claims the priority of U.S. patent application(s) Ser. No. 12/769,736, titled "METHOD AND APPARATUS FOR FLOOR PLANKS", filed on Apr. 29, 2010 now U.S. Pat. No. 8,268,110 and Ser. No. 12/950,546, titled "METHOD AND APPARATUS FOR FLOOR TILES AND PLANKS", filed on Nov. 19, 2010.

FIELD OF THE INVENTION

This invention relates to improved methods and apparatus concerning floor tiles and planks, such as for example, vinyl floor tiles and planks, rubber floor tiles and planks and other resilient floor tiles and planks.

BACKGROUND OF THE INVENTION

There are various devices known in the prior art concerning floor planks. One or more prior art techniques concerning floor planks are shown in U.S. Pat. Nos. 7,155,871 and 7,322,159, which are incorporated by reference herein.

There are various devices known in the prior art concerning floor tiles and planks. One or more prior art techniques concerning floor planks are shown in U.S. Pat. No. 4,195,107 to Timm, U.S. Pat. No. 4,180,615 to Bettoli, U.S. Pat. No. 4,348,477 to Miller, U.S. Pat. No. 4,990,188 to Micek, U.S. Pat. No. 4,439,480 to Sachs, and U.S. Published patent application Ser. no. US 2006/0156663 to Chen-chi Mao, which are incorporated by reference herein.

Known polyvinyl chloride (PVC) floor planks and tiles (so-called vinyl floor in U.S., or PVC floor in Europe, Australia and some other Asian and African countries) employ specialized adhesives (such as "pressure sensitive" adhesives) for affixing the floor planks or tiles to a subfloor, subfloor surface, or underlayment. Two major methods are used for applying adhesives for so called PVC or vinyl floors. In the first method, adhesive is manually applied onto the surface of subflooring or underlayment, and then the vinyl floor is manually applied to the adhesive-coated surface of subflooring or underlayment. In the second method an adhesive-backed vinyl floor plank or tile is provided, in which the adhesive is already applied over the back of vinyl floor or floor plank or tile, without the need of preparing an adhesive-coated surface on top of the subflooring or underlayment. However, typically for the second method, a flooring primer may need to be applied on top of the surface of the subflooring or underlayment, depending on the condition of the subfloor or underlayment. The second known method helps to provide a substantial saving in labor and time by simply allowing removal of a backing, such as a piece of paper or plastic film coated with releasing substance such as polyurethane, silicone, or acrylic, to expose a protected adhesive material on the back of a floor plank or tile.

However, the two aforementioned known methods of floor plank or tile installation do not provide satisfactory performance due to some significant problems. Firstly, for either method, the job of planning installation of a new floor, including many floor planks or tiles, can be confusing. It may be difficult to properly position and balance the overall vinyl floor (comprised of many floor planks or tiles) in a room. Before laying the floor planks or tiles down, measuring and centering the underlayment may be formidable. Any mistake made at a beginning stage may require removal, replacement, repair, or even entire re-installation of all of the floor planks or tiles.

Secondly, for a renewal or replacement installation, i.e. for a replacement of an existing vinyl floor with a new vinyl floor, a complete cycle for the renewal or replacement installation can be relatively long because among other reasons, removal and replacement are somewhat challenging. Sometimes, the removability of a fully adhered vinyl floor (including a plurality of floor planks or tiles) comes up with great difficulty. Furthermore, repair can be arduous, too. Repair usually involves removing existing or damaged vinyl floor planks or tiles or even an entire floor comprised of many floor planks or tiles. Repair may also involve scraping and patching the subflooring, and remedying, such as leveling and repairing, the underlayment, and re-spreading adhesive on top of the repaired or remedied subflooring.

Thirdly, diverse varieties of subflooring and underlayment with distinct qualities and conditions need to be cautiously evaluated during the preparation of installation of a vinyl flooring, including contents of moisture, smoothness of surface, leveling of ground, cleanness of surface, rating of alkali and other factors. Most of pre-installation tests can exclusively be accomplished by professional contract installers, manufacturers or laboratories.

Fourthly, the particular subflooring or underlayment onto which the vinyl floor planks or tiles must be laid may be comprised of any one of a wide variety of materials such as concrete, gypsum, plywood, and existing floorings such as vinyl, ceramic, hardwood, and laminate. Each one of these different subflooring or underlayment materials typically has different features and properties, and the adhesive applied to the subflooring must take into account these different features and properties. For example, a different adhesive may need to be applied to a concrete subflooring versus a plywood subflooring, or the adhesive may need to be applied in a different manner depending on the subflooring material Fifthly, the brands, qualities and types of adhesive, particularly the contents, ingredients and physical properties, may influence or even impact the performance of installation of PVC or vinyl floor planks or tiles. Therefore, installers, whoever are professional contractors or amateur consumers need to spend additional time to research and study different types of adhesives, or may also need technical support from manufacturers, manufacturer's representatives or manufacturer's distributors.

Sixthly, some types of adhesive may fail to maintain adequate cohesion strength because of the problem of plasticizer migration into adhesive. Plasticizer typically exists in the base layer of vinyl floors, or may exist in some resilient type of underlayment or subflooring. Storage conditions and storage period of adhesives may also impact how the adhesives adhere to a surface.

Seventhly, excessive use of adhesives may cause "ooze", which means adhesive coming out from seams or joints between floor tiles or planks. This "ooze" causes an undesirable visual appearance on the flooring and/or in the waste of labor and time to get rid of and clean up.

Eighthly, deficit or unevenness of spreading adhesive may cause installation failure due to loose pieces from subflooring or underlayment.

In addition to the difficulties of implementing installation satisfactorily, as mentioned above, another disadvantage is that the application of adhesive produces essentially permanent structures that are difficult to alter, repair or remove once a vinyl floor, including a plurality of vinyl planks or tiles, has been installed. There are various hardware tools and chemicals for removing adhesive-installed vinyl floors, however, it is very difficult, if not impossible to completely eliminate adhesive residue from a subflooring or underlayment, or to completely restore a subflooring to an original intact condition.

Traditionally, adhesive is absolutely required to achieve the installation of vinyl floor. However, before, during and after the use of adhesive all may have inconveniences, concerns and problems to both household amateur consumers and professional contract installers.

It is known to magnetically adhere floor planks or tiles to an iron or other metal subfloor. For example, a process is known of laying magnetic-backed vinyl tiles on an iron sheet. The iron sheet typically contains a synthetic plastic composition material filled with iron powder, and the iron sheet is typically provided on a roll or in sheets.

SUMMARY OF THE INVENTION

At least one embodiment of the present invention provides a method comprising the steps of putting together a first piece, wherein the first piece is comprised of a wear layer, a pattern layer, and a base layer, with the wear layer, the pattern layer, and the base layer arranged in a sandwich manner, such that the wear layer is on top of the pattern layer, the pattern layer is on top of the base layer, and the pattern layer is in between the wear layer and the base layer. The method may also include removing portions of the first piece to form a first floor plank.

The step of removing portions of the first piece to form a first floor plank may include removing a first substantially L-shaped portion of the wear layer, removing a second substantially L-shaped portion of the pattern layer, and removing a third substantially L-shaped portion of the base layer. The first substantially L-shaped portion of the wear layer and the second substantially L-shaped portion of the pattern layer are substantially the same size and shape, and are substantially aligned with one another prior to being removed from the first piece. The third substantially L-shaped portion of the wear layer is not aligned with the second substantially L-shaped portion of the pattern layer or the first substantially L-shaped portion of the wear layer prior to being removed from the first piece.

The step of removing portions of the first piece to form a first floor plank may be performed by a machine, such as a bevel machine.

The method may also include applying adhesive to locations on the first floor plank corresponding to where portions of the first piece have been removed. A removable covering may be applied to the adhesive so that the first floor plank can be stored for later installation as part of a floor covering.

The step of removing the first substantially L-shaped portion of the wear layer and the second substantially L-shaped portion of the pattern layer may include forming a first substantially L-shaped slot and a first substantially L-shaped rail. The step of removing the third substantially L-shaped portion of the base layer may include forming a second substantially L-shaped slot and a second substantially L-shaped rail. Adhesive may be applied to at least one of the first and the second substantially L-shaped slots and to at least one of the first and second substantially L-shaped rails, for adhering one floor plank with one or more substantially identical floor planks.

The method may further include applying a removable covering to the adhesive so that the first floor plank can be stored for later installation as part of a floor covering. The method may further include removing the removable covering from the first floor plank, and adhering the first floor plank to a second floor plank, which is substantially identical to the first floor plank, by adhering locations on the first floor plank corresponding to where portions of the first piece have been removed to locations on the second floor plank corresponding to where portions of a second piece have been removed, wherein the second piece is substantially identical to the first piece.

In at least one embodiment of the present invention an apparatus is provided which includes a piece for flooring. The piece for flooring may be a floor plank or floor tile. The piece for flooring may be comprised of a wear layer, a pattern layer, a base layer, and a backing layer. The base layer may be made of a mixture comprised of ilmenite powder. About one third of the mixture may be ilmenite powder. The mixture may also be comprised of calcium carbonate. The mixture may be comprised of calcium carbonate, wherein about one quarter of the mixture is calcium carbonate. The mixture may be further comprised of polyvinylchloride, wherein about one quarter of the mixture is polyvinylchloride. The backing layer may include a plurality of devices which are hexagonally shaped, and wherein the plurality of devices form a honeycomb structure which contacts a top floor surface when the piece is placed on the top floor surface. The backing layer may have a bottom surface including anti-slip backing film. The anti-slip backing film may be comprised of polyurethane.

At least one embodiment of the present application may include a method which may be comprised of placing a plurality of pieces for flooring on a subfloor to form a floor, wherein each of the plurality of pieces is comprised of a wear layer, a pattern layer, a base layer, and a backing layer; and wherein the base layer is made of a mixture comprised of ilmenite powder. Each of the plurality of pieces may be placed on the subfloor without applying an adhesive to adhere the plurality of pieces to the subfloor. Each of the plurality of pieces may have a structure or a composition as previously described.

At least one embodiment of the present invention provides a method and apparatus for installing floor planks or tiles. In at least one embodiment of the present invention, floor planks or tiles are installed without applying an adhesive to adhere the floor planks to a subflooring.

A principle object of one or more embodiments of the present invention is an improved technique in installing flooring, such as installing vinyl flooring, including floor tiles and planks. A floor plank or tile in accordance with an embodiment of the present invention may include an additional layer or supplemental coating, such as an anti-slip layer, on the back of the floor plank or tile.

It is another object of one or more embodiments of the present invention to provide a unique technique for attaching floor planks or tiles, such as vinyl floor planks or other resilient floor planks or tiles to subfloors, underlayments, or equivalent substrates.

It is another object of one or more embodiments of the present invention to provide floor planks or tiles which are configured to be attached to structural sub surfaces with a minimum of skill, effort and cost.

It is a further object of one or more embodiments of the present invention to provide a method and/or apparatus for floor planks or tiles, which allow floor planks or tiles to be fixed to structural sub surfaces without shifting over time, with use, due to outdoor weather, due to indoor temperature changes, due to foot traffic pivoting, or furniture movement.

It is a further object of one or more embodiments of the present invention to provide a non-movable, anti-slip layer or film laminated underneath a vinyl floor or equivalent resilient floor covering which is durable, non-deteriorating and not subject to blistering or bubbling from the effect of moisture or chemicals.

One or more embodiments of the present invention provide a non-skid substance coated over the surface of floor plank's or tile's backing layer. The non-skid substance may be durable, non-deteriorating and not subject to blistering or bubbling from the effect of moisture and chemicals.

One or more embodiments of the present invention may provide an abradant particle or particles such as carborundum, emery, corundum, asphalt, pitch, or bitumen embedded over the backing layer of a floor plank. The abradant particle, particles, or material may be durable, non-deteriorating and not subject to blistering or bubbling from the effect of moisture and chemicals.

One or more embodiments of the present invention may provide anti-slip emboss or texture on the backing layer of a floor plank, such as a resilient floor plank, which is durable, non-deteriorating and subject to strengthen the immovability of floor tiles or planks, when they are installed on a subfloor surface.

One or more embodiments of the present invention may provide a certain amount of a heavy weight substance added into a base layer as a filler for a resilient floor plank or tile. The heavy weight substance may enhance the immovability of tiles or planks.

Other objects or further scopes of applicability of one or more embodiments of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled the art from this detailed description.

At least one embodiment of the present invention provides a method comprising the steps of putting together a first piece, wherein the first piece is comprised of a protective wear layer, a pattern layer, a resilient synthetic base layer, and a non-movable, anti-slip backing layer; with the wear layer, the pattern layer, base layer and backing layer, arranged in a sandwich manner, such that the wear layer is on top of the pattern layer, the pattern layer is on top of the base layer, the base layer is on the backing layer, and the pattern layer and base layer are between the wear layer and the backing layer.

In at least one embodiment, the method includes applying numerous embossed or textured cupules or devices (by press through heat or by engraving) on the backing layer. The devices or cupules on the backing layer may be arranged like regular hexagon honeycomb or beehive, but other patterns for the devices may be provided such as honeycomb, diamond, square, triangle and other patterns such as from a treadplate. The height of regular hexagon honeycomb may be about 0.1 millimeters to 0.3 millimeters. The distance between each two horizontal sides of adjacent devices or cupules may be three millimeters (mm) to five millimeters (mm). For a better performance, above mentioned height and horizontal distance of hexagon honeycomb can be adjusted.

In at least one embodiment, a method may further include applying a PVC non-movable anti-slip film or polyurethane non-movable, anti-slip film, or other substances with similar function, such as anti-slip textile, coating of aluminum oxide infused polyurethane (PU), Epoxy resin, acrylic, or Teflon (polytetrafluroethylene).

In at least one embodiment, a method may further include applying powdered ilmenite, or titanium powder, or copper powder, or tin powder to a synthetic mixture of polyvinyl chloride powder, Calcium Carbonate and other additives for producing the base layer of floor plank or tile, such as a resilient floor plank or tile, such as a vinyl floor plank or tile.

In at least one embodiment of the present application a floor plank is provided comprising a wear layer, a pattern film, and a magnetic base layer. The floor plank may have a length, a width, and a thickness, wherein the length and the width are substantially larger than the thickness. The magnetic base layer may have a magnetic field which is in a direction substantially parallel to a plane defined by the length and the width of the floor plank, and wherein the direction of the magnetic field is substantially perpendicular to the thickness of the floor plank.

The floor plank may further include an anti-slip layer, such as an anti-slip polyvinyl chloride layer or an anti-slip polyurethane layer. The pattern film is arranged so that it is between the wear layer and the magnetic base layer. The magnetic layer may have a magnetic north pole running along the length of the floor plank at a first end of the floor plank, and the magnetic layer may have a magnetic south pole running along the length of the floor plank at a second end of the floor plank, which is opposite the first end.

The floor plank may include a plurality of channels and rails, wherein each channel of the floor plank is configured to tightly receive a rail of an identical floor plank and each rail of the floor plank is configured to tightly fit into a channel of an identical floor plank. The floor plank may include a layer of a plurality of protruding devices. Each of the plurality of protruding devices may have a hexagonal surface.

In at least one embodiment, a method is provided, which includes placing a first floor plank on a subfloor, and placing a second floor plank, next to the first floor plank on the subfloor. Each of the first floor plank and the second floor plank may be as previously described. The first floor plank and the second floor plank may be placed on the subfloor so that the first floor plank and the second floor plank are adjacent one another and so that a magnetic pole of the magnetic base layer of the first floor plank is attracted to an opposite magnetic pole of the magnetic base layer of the second floor plank to thereby connect the first floor plank and the second floor plank.

DETAILED DESCRIPTION OF THE DRAWINGS

Figure 1A:
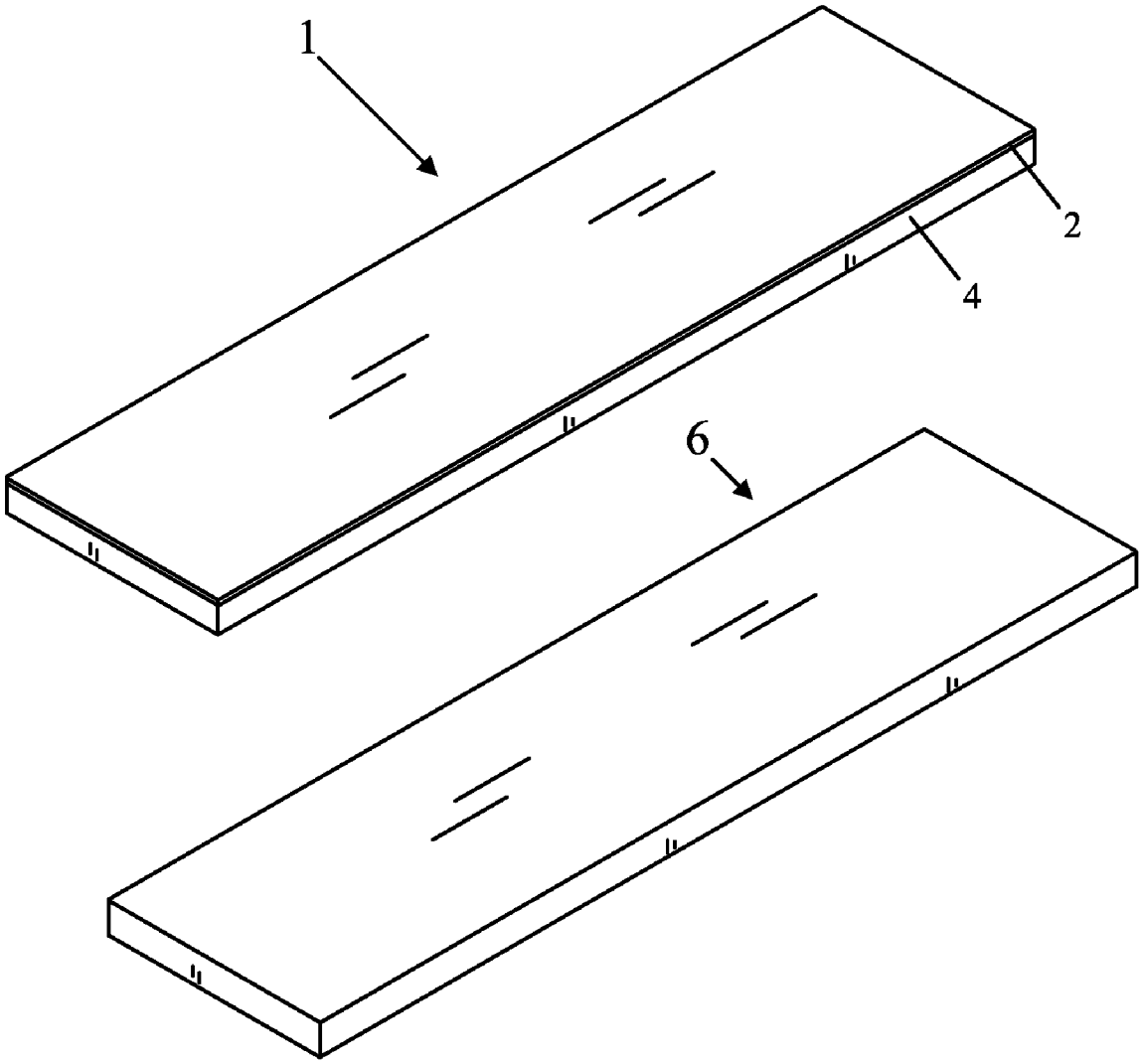
Fig. 1A (Prior Art)
FIG. 1A shows a top front, right perspective view of two parts for creating a floor plank in accordance with a prior art technique, with the two parts not connected together.

FIG. 1A shows a top front, right perspective view of a part 1 and a part 6 for forming a floor plank in accordance with a prior art technique, with the two parts not connected together.

Figure 1B:
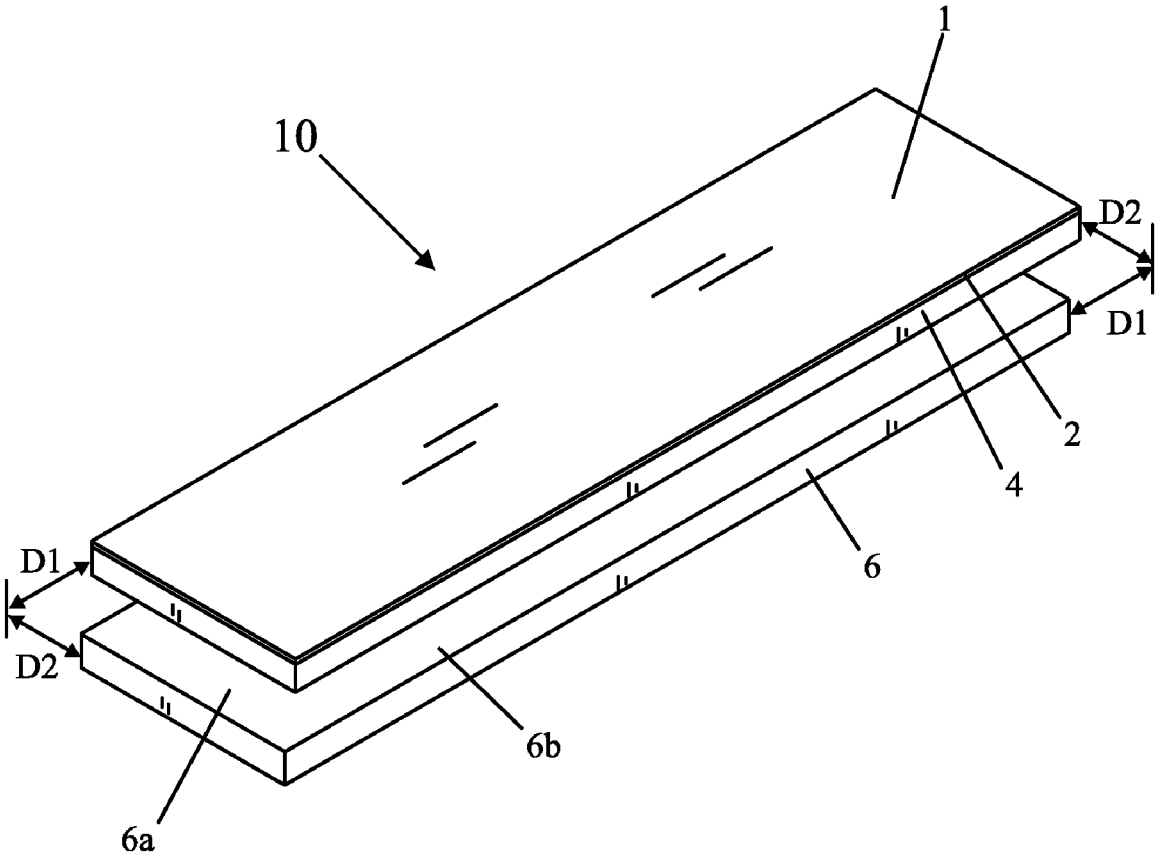
Fig. 1B (Prior Art)
FIG. 1B shows the two parts of the floor plank of FIG. 1A, with the two parts attached to each other in an offset manner, in accordance with a prior art technique.
Figure 7:
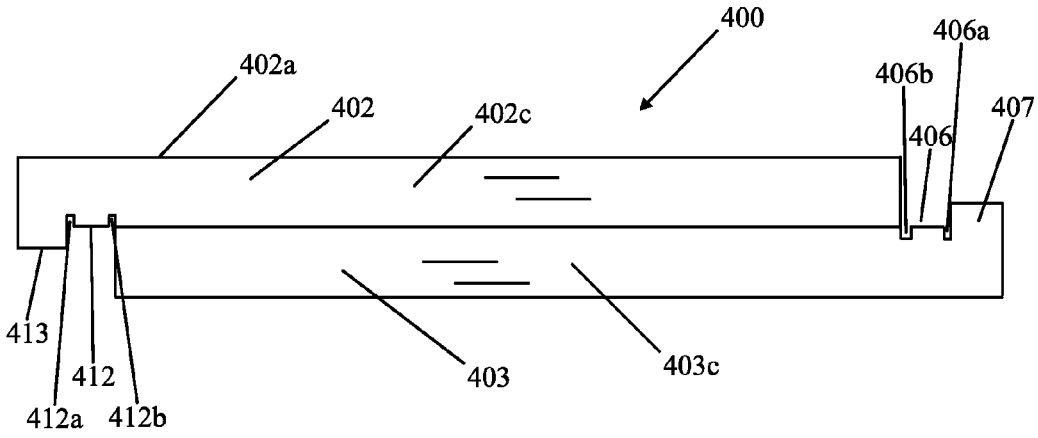
FIG. 7 shows a left side view of a floor plank in accordance with another embodiment of the present invention.
Figure 8:
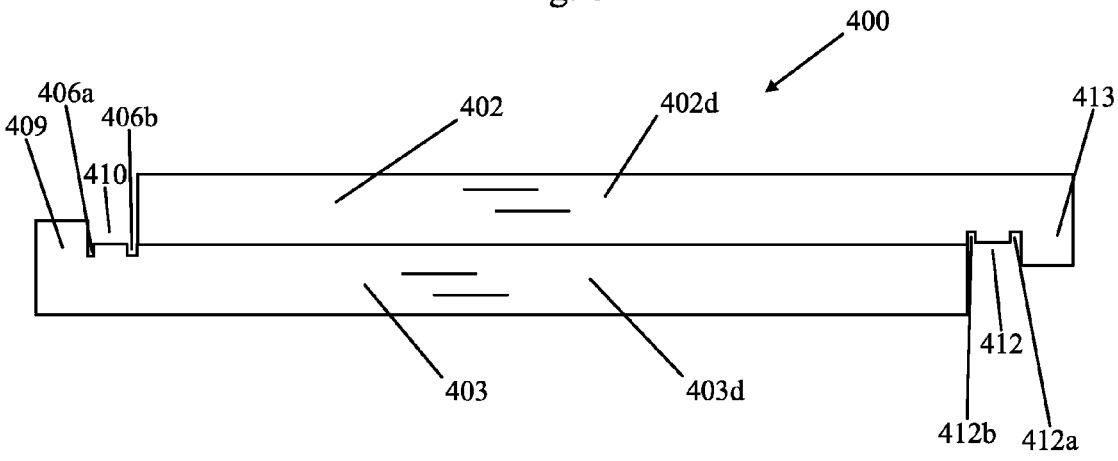
FIG. 8 shows a right side view of the floor plank of FIG. 7.
Figure 9:
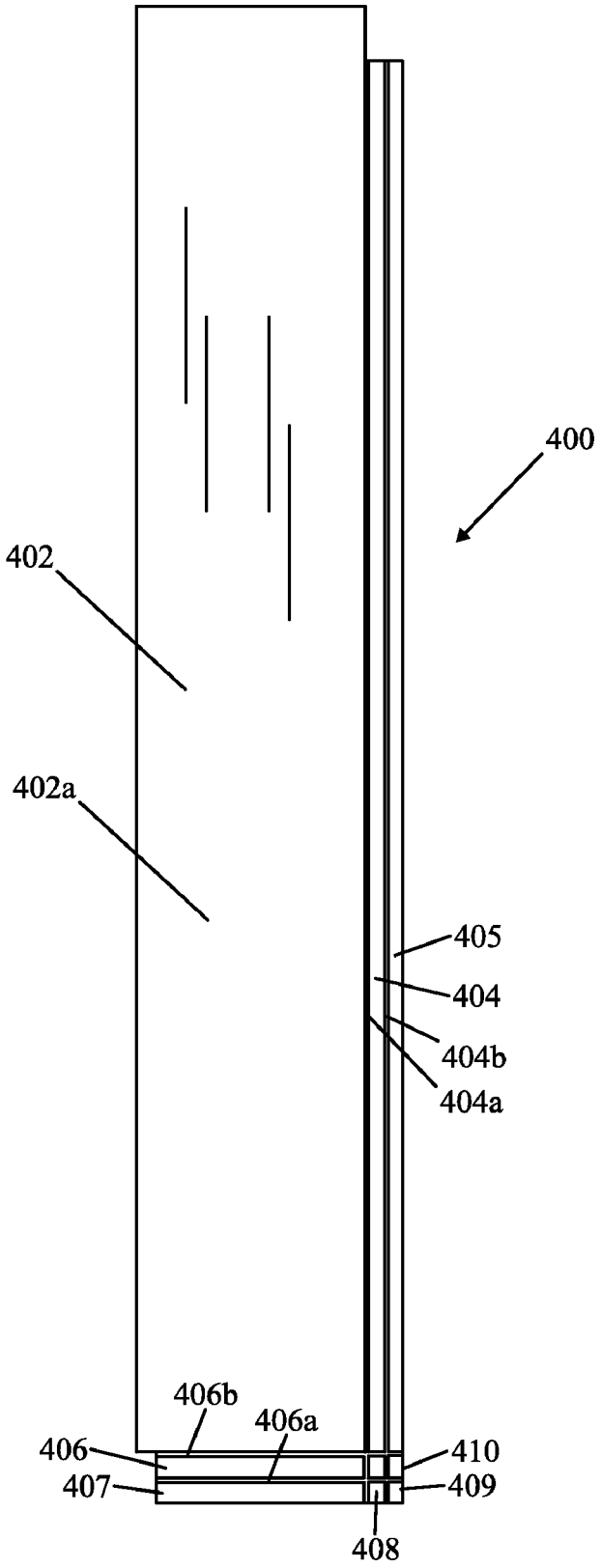
FIG. 9 shows a top view of the floor plank of FIG. 7.
Figure 10:
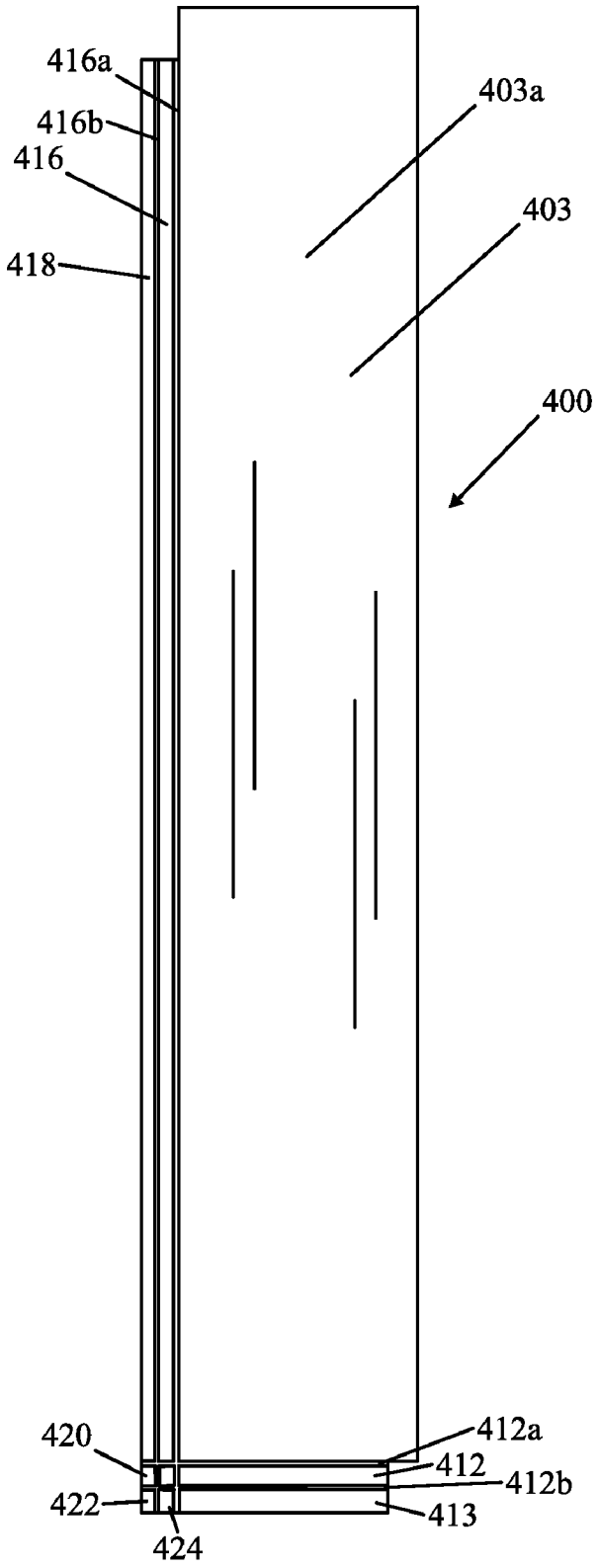
FIG. 10 shows a bottom view of the floor plank of FIG. 7.

FIG. 1B shows the part 1 and part 6 of FIG. 1A, with the two parts 1 and 6 attached to each other in an offset manner, in accordance with a prior art technique. Such a prior art technique is shown in U.S. Pat. Nos. 7,155,871 and 7,322,159, which are incorporated by reference herein. In these patents, a top layer 14, which typically includes a design, such as a synthetic wood grain or a polyvinyl chloride (PVC) design, is laminated to a middle plastic layer 16, in an offset manner to form a plank 100. (U.S. Pat. Nos. 7,155,871 and 7,322,159, FIG. 7; col. 3, In. 60-65).

Figure 2:
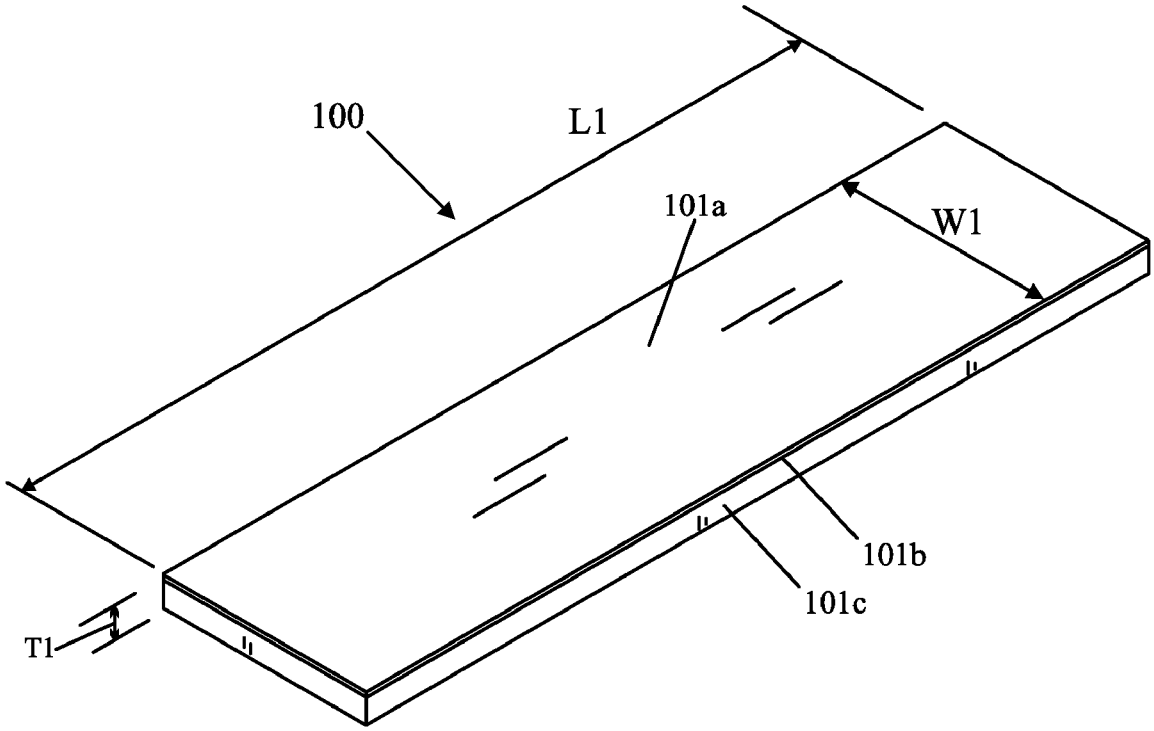
FIG. 2 shows a top, front, right perspective view of a piece to be used to create a floor plank in accordance with an embodiment of the present invention.

FIG. 2 shows a top, front, right perspective view of a piece 100 to be used to create a floor plank 100*a* (shown in FIG. 3) in accordance with an embodiment of the present invention. The piece 100 may be a rectangular block or strip having a top surface 101*a*. The piece 100 may have a layer 101*b* and a layer 101*c*. The layer 101*b* may include a wear layer or sublayer and a pattern (or design) layer or sublayer. The wear layer of the layer 101*b* may be a thin transparent layer. The pattern (or design) layer of the layer 101*b* may be a thin design layer, such as a synthetic wood grain design layer or a polyvinyl chloride synthetic wood grain design layer. The layer 101*c* may also be called a base layer. The piece 100 may have a length L1 and a width W1.

Figure 3:
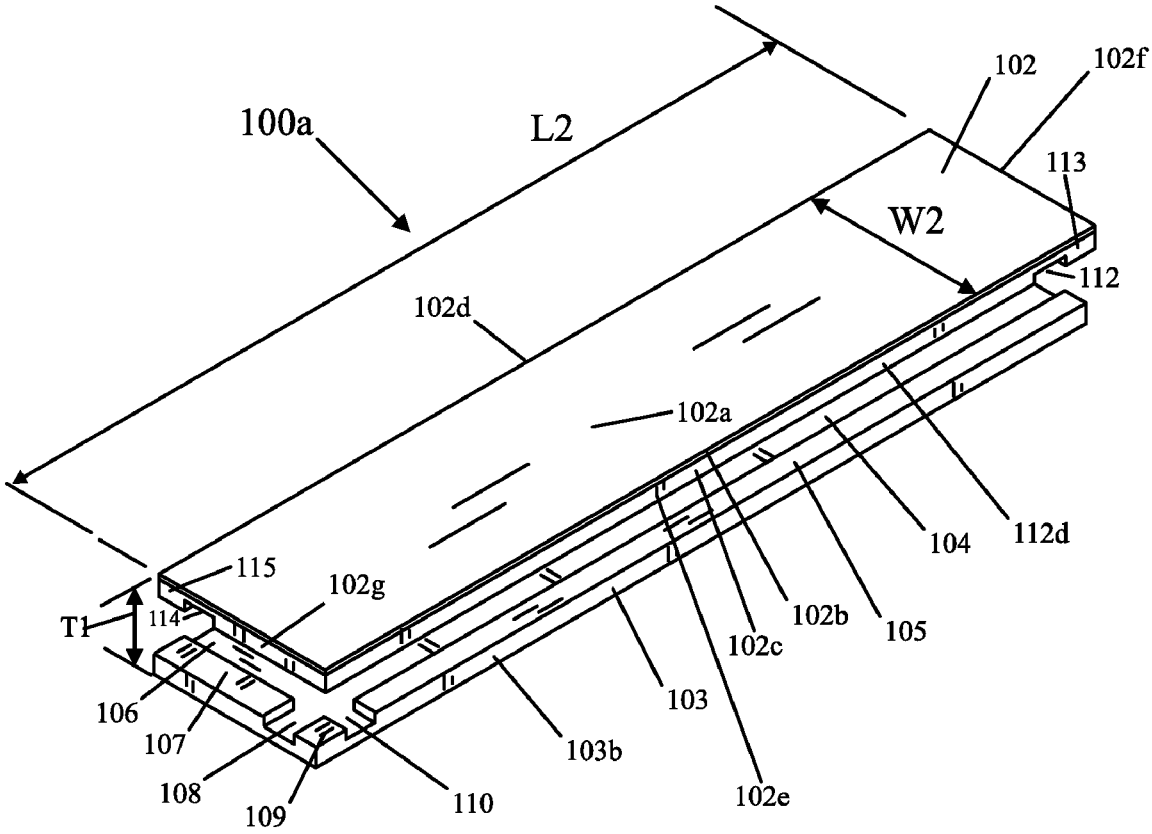
FIG. 3 shows a top, front, right perspective view of a floor plank, which has been created from the piece of FIG. 2, in accordance with an embodiment of the present invention.
Figure 4:
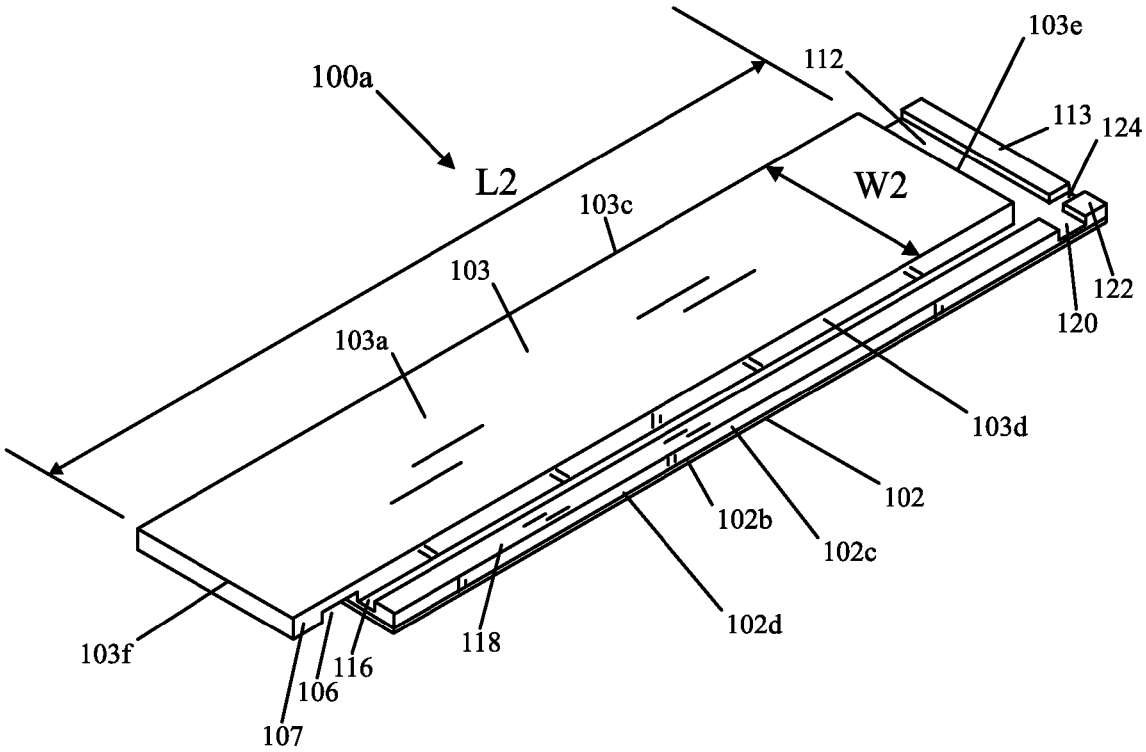
FIG. 4 shows a bottom, front, left perspective view of the floor plank of FIG. 3.

FIG. 3 shows a top, front, right perspective view of a floor plank 100*a*, created from the piece 100 in accordance with an embodiment of the present invention. FIG. 4 shows a bottom, front, left perspective view of the floor plank 100*a*. The floor plank 100*a* may be created from the piece 100 of FIG. 2, by cutting, beveling, etching, sculpting, carving, or chiseling out or otherwise removing portions of the piece 100. Thus the floor plank 100*a* is formed from a piece 100 in accordance with at least one embodiment of the present invention, in contrast to the prior art plank of U.S. Pat. Nos. 7,155,871 and 7,322,159 which is formed by laminating one layer onto another, in those patents.

The floor plank 100*a* shown in FIG. 3, formed from the piece 100, includes a top portion 102 and a bottom portion 103. The top portion 102 may have a wood veneer surface 102*a* or synthetic plastic surface for a floor. The surface 102*a* may be printed plastic. The top portion 102 may include a layer 102*b* and a layer 102*c*. The layer 102*b* may include a wear layer and a pattern or design layer. The layer 102*b* has a length L2, which is less than L1 in FIG. 2, and a width W2 which is less than the width W1. The layer 102*b* is a modified version of the layer 101*b*, with an L-shaped section of the layer 101*b* removed by cutting, beveling, etching, sculpting, carving, or chiseling out or otherwise removing the L-shaped section of the layer 101*b* to form the layer 102*b*. The combination of the layer 102*c* and the portion 103 shown in FIG. 3, is a modified version of the layer 101*c* of the piece 100 shown in FIG. 2, with various portions of the layer 101*c* removed by cutting, beveling, etching, sculpting, carving, or chiseling out or otherwise removing various portions, such as L-shaped portions, of the layer 101*c* to form the layer 102*c* and portion 103.

The layer 102*c* and the portion 103 shown in FIG. 3 may substantially be made of PVC (polyvinyl chloride) synthetics, which may be of the type used in conventional vinyl floor planks.

The floor plank 100*a* may further include slots or channels 104, 106, 108, and 110 shown in FIG. 3, and slots or channels 112, 116, 120, and 124 shown in FIG. 4, which may be formed by cutting, beveling, etching, sculpting, carving, or chiseling out or otherwise removing various portions, such as for example L-shaped portions, of the piece 100 of FIG. 2 to form the floor plank 100*a* of FIG. 3. The floor plank 100*a* may further include rails or protrusions 105, 107, 109, 113, and 115 shown in FIG. 3, and rails or protrusions 118 and 122 shown in FIG. 4, which may be formed by cutting, beveling, etching, sculpting, carving, or chiseling out or otherwise removing various portions of the piece 100 of FIG. 2 to form the floor plank 100*a* of FIG. 3.

The floor plank 100*a* may include a base layer which may be comprised of layer 102*c* and portion 103. The base layer may include a balance layer and a leveling layer. Typically, in at least one embodiment, only a base layer comes out of a calendering machine or extruder machine. The base layer is then immediately laminated, first with a pattern film and then with a wear layer, or with the pattern film and the wear layer at the same time, to form the piece 100 shown in FIG. 2. To form the piece 100, the combination of the wear layer and the pattern film or design layer 101*b* is laminated to the base layer 101*c*, to form a uniform rectangular block or strip in which layers 101*b* and 101*c* are aligned and neither of the layers 101*b* and 101*c* extend substantially beyond the other layer.

The wear layer is transparent, is part of the layer 102*b*, and is on the surface 102*a* of the floor plank 100*a* shown in FIG. 3. The pattern layer lies underneath the wear layer or surface 102*a*, and is also part of the layer 102*b*. The pattern layer typically takes up a relatively small part or cross section versus the cross section taken up by the layer 102*c* and the portion 103. As examples, the thickness of the pattern layer (of layer 102*b*) or film may be about 0.07 millimeters, while the typically transparent wear layer (of layer 102*b* in FIG. 3) or surface 2*a* can be from 0.03 millimeters to 1.2 millimeters. A wear layer in the range of 0.03 millimeters to 0.30 millimeters wear layers usually is used with an overall tile/plank 100*a* thickness T1, shown in FIG. 3, of between 1.5 millimeters and 3.0 millimeters. The overall plank thickness of plank 100*a* shown in FIG. 3 is equal to the thickness T1 of the unmodified piece 100 shown in FIG. 2. A wear layer in the range of 0.35 millimeters to 1.2 millimeters typically would be used with an overall tile/plank 100*a* thickness T1 above 2.5 millimeters.

Typically a cutting die would be used to form the edges of the piece 100 which may be in the form of a conventional known plank or tile. A bevel machine or some other type of machine can be used to cut, bevel, etch, sculpt, carve, chisel out or otherwise form the slots or channels such as, slots or channels 104, 106, 108, 110, shown in FIG. 3, and slots or channels 112, 116, 120, and 124 shown in FIG. 4 or to form the rails or protrusions 105, 107, 109, 113, and 115 shown in FIG. 3, and rails or protrusions 118 and 122 shown in FIG. 4, in order to modify the piece 100 of FIG. 2 into the floor plank 100*a* of FIG. 3.

The base layer 101*c* of the unmodified piece 100 may be made in advance by calendering (sophisticated, base layer will be thin) or by sets of rollers (simple, base layer will be thicker). The wear layer, pattern film (layer 101*b* includes wear layer and pattern layer) and base layer (layer 101*c* may then be properly aligned, so that each layer has substantially the same length and width, is aligned with the other layers, and does not extend substantially beyond the other layers. After cutting, the aligned layers (101*b* and 101*c*) may then be sent to a hot press machine for lamination to form the piece 100.

A cutting die can be installed with a calendering machine or extrusion machine, so the entire production process may be made to be automatic and continuous. But due to technique bottleneck or budget limit, factory can also cut lamination sheet into slab, then send to independent, or stand off, cutting die to shape into piece 100.

The wear layer or the layer 101*b* is transparent, and typically has a thickness of from 0.03 millimeters to 1.2 millimeters. The base layer, or layer 101*c* of the piece 100, can itself be comprised of more than one layer, such as one, two, or three layers, typically depending on the thickness T1 of the piece 100. Although the base layer 101*c* may be comprised of more than one layer, it will still appear to be one layer, because any multiple layers of the base layer 101*c* will be laminated together, unless the layers are different colors.

The wear layer of the layer 101*b* of the piece 100, may be pure PVC, with greater pulling power (upward) when temperature goes down (for example, a relatively higher processing temperature versus relatively lower room temperature), and for such a PVC wear layer, typically a balance layer as part of the base layer 101*c* of the piece 100 is used to offset the pulling power of the wear layer. A leveling layer of the base layer 101*c* of the piece 100, would be the bottommost layer and is aimed at the subfloor or underlayment. If the subfloor or underlayment is uneven or not level, a relatively flexible leveling layer can help to keep a floor comprise of a plurality of planks identical to plank 100*a*, flat.

A fiber glass layer may optionally be placed between the pattern film layer at the bottom of layer 101*b* and the base layer 101*c* (or may be placed between leveling layer and balance leveler), however alternatively, fiber glass materials can be mixed in with the base layer 101*c* of the piece 100. Fiber glass materials mixed in with the base layer 101*c* can provide better dimensional stability.

For the lowest (price wise) end product for residential uses, a pattern may be printed on the back of a wear layer, then a pure white film may be paved underneath the pattern (on the non-pattern side) which is called a "feature layer/film". The combination wear layer (with pattern on back) and "feature layer/film" may then be laminated onto a base layer, and thereafter a large slab or sheet including the combination wear layer and the base layer may be die cut to form a plurality of pieces each identical or similar to piece 100. For better anti-scratch, anti-cuff and better durability of the surface 102*a,a* coating may be spread on top of the surface 102*a*, such as a polyurethane coating. A coating of silicone, Teflon, or epoxy and other types of coatings may also be used on the surface 102*a*.

On the back of the floor plank or tile such as on surface 103*a*, shown in FIG. 4, there is typically a need to provided protection from moisture from the subfloor or underlayment under the tile/plank 100*a*. A sealer may be applied to the back surface 103*a*, or the sealer may be laiminated onto the back surface 103*a*. The sealer may be an anti-moisture film, for example such as a thin layer of pure PVC (polyvinyl chloride) film.

Figure 5:
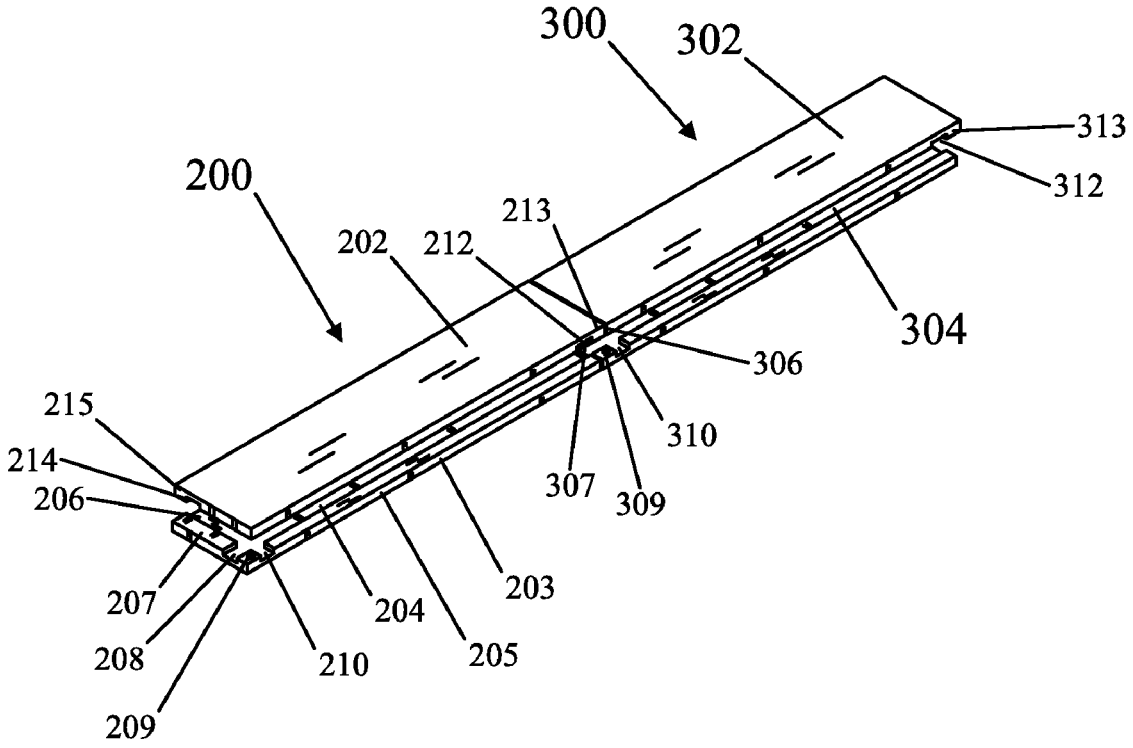
FIG. 5 shows a top, front, right perspective view of two identical floor planks in accordance with an embodiment of the present invention, connected to each other lengthwise.

FIG. 5 shows a top, front, right perspective view of two identical floor planks 200 and 300 in accordance with an embodiment of the present invention, connected to each other lengthwise. Each of floor planks 200 and 300 is the same as floor plank 100*a* shown in FIGS. 3 and 4. The floor plank 200 includes rails 205, 207, 209, 213, and 215 shown in FIG. 5, which are the same as rails 105, 107, 109, 113, and 115, respectively. Floor plank 200 includes slots or channels 204, 206, 208, 210, and 212 shown in FIG. 5 which are the same as slots or channels 104, 106, 108, 110, and 112, respectively. The floor plank 300 includes rails 307, 309, and 313 shown in FIG. 5 which are the same as rails 107, 109, and 113, respectively. The floor plank 300 includes slots or channels 310, 304, and 312, shown in FIG. 5, which are the same as slots or channels 110, 104, and 112, respectively. In FIG. 5, the rail 307 of the floor plank 300 fits into the slot 212 of the floor plank 200; and the rail 213 of the floor plank 200 fits into the slot 306 of the floor plank 300 to connect the floor planks 200 and 300 lengthwise.

Figure 6:
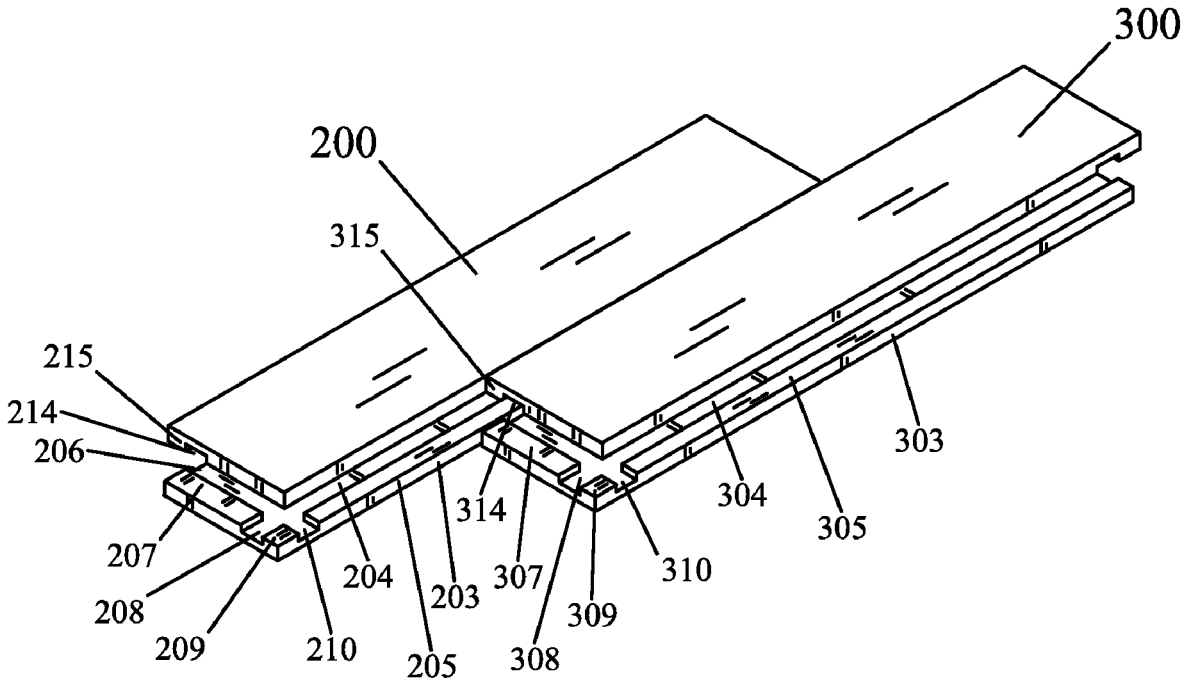
FIG. 6 shows a top, front, right perspective view of two identical floor planks in accordance with an embodiment of the present invention, connected to each other widthwise.

FIG. 6 shows a top, front, right perspective view of two identical floor planks 200 and 300 in accordance with an embodiment of the present invention, connected to each other widthwise. The two floor planks 200 and 300 may be offset with respect to each other when they are connected. Any further number of identical floor planks (similar to floor plank 100*a* in FIG. 3) can be connected lengthwise to the arrangement shown in FIG. 5 and widthwise to the arrangement shown in FIG. 6 to cover an entire floor. In FIG. 6, the rail 315 of the floor plank 300 fits into the slot 204 of the floor plank 200; and the rail 205 of the floor plank 200 fits into the slot 314 of the floor plank 300 to connect the floor planks 200 and 300 widthwise.

The piece 100 shown in FIG. 2 can be produced by a process such as a process involving the use of a calender (a series of hard pressure rollers), by an extrusion process (a process used to create objects of fixed cross-sectional profile), or by a hot press or flat press process (such as involving the simultaneous application of heat and pressure).

The base layer 101*c* of the piece 100 of FIG. 2, can be comprised of a balance layer and a leveling layer. Usually, a black leveling layer and a black balance layer are laminated together as one layer for the base layer (sometimes, factory produces just one thicker layer). The leveling layer of the base layer would be the bottommost layer of the layer 101*c* of the piece 100.

The base layer, following cutting away portions of the piece 100 to form the plank 100*a* (wherein the base layer may be most of layer 102*c* and most of portion 103 in FIG. 3) may be comprised of one or more of the following materials polyvinyl chloride (PVC), calcium carbonate(filler), DOP or DINP, (DOP (Dioctyl Phthalate) is a combustible non-toxic colorless oily liquid with slight odor. Diisononyl phthalate (DINP) has similar functions and properties as DOP but environmental-friendly, a lubricant, a plasticizer, and/or various additives. The wear layer, such as on surface 102*a* in FIG. 3, the pattern film (thin layer underneath surface 102*a*), and the base layer (most of layer 102*c* and portion 3) may be laminated to each other through heat. The piece 100 of FIG. 2, may be initially formed by being die cut. However, in accordance with an embodiment of the present invention the piece 100 is not die cut in order to modify the piece 100 and to form plank 100*a*. The slots or channels 104, 106, 108, and 110 shown in FIG. 3, slots or channels 112, 116, 120, and 124 shown in FIG. 4, rails or protrusions 105, 107, 109, 113, and 115 shown in FIG. 3, and rails or protrusions 118 and 122 shown in FIG. 4 are typically not formed by being die cut.

Instead of die cutting to initially form the piece 100, another method such as waterjet, and CNC, Computer numerical control, which utilizes the commands of numerical control program (compiled by computer) to drive a motor of machine can be used.

After die cutting or some other method is used to initially form the piece 100, the piece 100 is modified into plank 100*a*. A bevel machine can be used which has a simple operation system to modify the piece 100 into the plank 100*a* and to thereby form the slots or channels 104, 106, 108, and 110 shown in FIG. 3, slots or channels 112, 116, 120, and 124 shown in FIG. 4, rails or protrusions 105, 107, 109, 113, and 115 shown in FIG. 3, and rails or protrusions 118 and 122 shown in FIG. 4. A CNC program can also be installed to be used with the bevel machine to modify the piece 100 into the plank 100*a* to be more computerized and automatic.

In order to produce the floor plank 100*a* from the piece 100, at least a lengthwise portion along length L1 of piece 100 and at least a width wise portion along width W1 of piece 100 are removed, typically to form an L-shaped portion, by cutting, beveling, etching, sculpting, carving, or chiseling out or otherwise removing various portions of the piece 100 of FIG. 2 to form the floor plank 100*a* of FIG. 3. The piece 100 may be cut or sculpted so that there are sides 102*e* and 102*g* formed, each of which is at a ninety degree angle with respect to the surface 102*a* as s shown in FIG. 3. The piece 100 may also be cut, beveled, etched, sculpted, carved, or chiseled out or otherwise have portions removed so that there are sides 103*d* and 103*e* formed, each of which is at a ninety degree angle with respect to the surface 103*a* or back of the plank 100*a* as shown in FIG. 4. Alternatively, sides 102*e* and 102*g*, and sides 103*d* and 103*e* may be beveled to be at an inclined or sloped so that sides 102*e* and 102*g* are not at a ninety degree angle with respect to surface 102*a*.

After the piece 100 of FIG. 2 is altered to the plank of 100*a* by cutting, beveling, etching, sculpting, carving, or chiseling out or otherwise removing various portions of the piece 100 of FIG. 2 to form the floor plank 100*a* of FIG. 3, glue is spread on or in slots or channels 104, 106, 108, and 110 shown in FIG. 3, slots or channels 112, 116, 120, and 124 shown in FIG. 4, rails or protrusions 105, 107, 109, 113, and 115 shown in FIG. 3, and rails or protrusions 118 and 122 shown in FIG. 4. In at least one embodiment of the present invention, glue is placed on or in all surfaces of the plank 100*a* which were formed by the step of cutting, beveling, etching, sculpting, carving, or chiseling out or otherwise removing various portions of the piece 100 of FIG. 2 to form the floor plank 100*a*. In at least one embodiment of the present invention, only the top surface 102*a* and the bottom surface 103*a* of the floor plank 100*a* will not have adhesive on them. Typically, all surfaces of the plank 100*a* which will come in contact with surfaces of another identical plank 100*a*, when the planks 100*a* are laid out in a floor pattern (i.e. not including the top surface 102*a* in FIG. 3 and the bottom surface 103*a* in FIG. 4) will have adhesive placed on them.

The slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 are used for convenient position for better installation performance but are not required. If one or more slots 104, 106, 108, 110, 112, 116, 120, and 124 and rails 105, 107, 109, 113, and 115 are provided, they may be formed from the piece 100, by cutting the piece 100 of FIG. 2 by blade or alternative utility tools to form the plank 100*a*.

Adhesive may be spread out onto or in at least one of slot 104 in FIG. 3 and slot 116 in FIG. 4 and at least one of rail 103 in FIG. 3 or rail 118 in FIG. 4. Adhesive may also be spread out onto at least one of slot 106 in FIG. 3 or slot 112 in FIG. 4 and at least one of rail 107 in FIG. 3 and rail 113 in FIG. 4. In at least one embodiment a non-dry adhesive may be used for the adhesive. After forming plank 100*a* from piece 100 adhesive is spread at the factory on or in the appropriate slots or rails (such as one or more of slots 104, 116, 106, and 112 and one or more of rails 103, 118, 107, and 113), and then a piece of double sided coated paper is laid between two adjacent tiles/planks, each identical to floor plank 100*a*, to prevent contact between the two floor planks 100*a* and their adhesives before installation on a surface of a floor.

The slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 can be various length or widths. The slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 are used to align floor planks, such as floor planks 200 and 300 (each identical to 100*a*) as shown in FIGS. 5 and 6. The slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 are optional and can be eliminated in one or more embodiments.

In accordance with an embodiment of the present invention end-users don't have to spread any adhesive on tile/plank 100*a* or on the subfloor/underlayment. Also excessive adhesive will flow to a slot or channel instead of going up to the surface of a floor plank 100*a* or floor planks when they are abutted against one another. For example, excessive adhesive from rail 105 will flow into slot 104 in FIG. 3 and excessive adhesive from side rail 118 will flow into channel 116 shown in FIG. 4. The sides or vertical edges 102*d*, 102*e*, 102*f*, 102*g* shown in FIG. 3, and the side or vertical edges 103*c*, 103*d*, 103*e*, and 103*f* typically do not have adhesive initially applied to them, but rather adhesive may migrate to these sides or vertical edges from slots or rails when, for example, two identical planks 100*a* are connected together.

Non-dry adhesive will flow due to pressure or heat (or migration, which is kind of interaction between adhesive and DOP/DINP). Migration, to some customers which means excessive adhesive; but to those skilled in the art, it may also means that adhesive became watery, kind of deteriorated.

The piece 100 may have a length L1, which may for example be thirty-six or forty-eight inches or any other length, and a width W1, which may be three, four, six, eight, nine, or twelve inches or any other width. The piece 100 may be replaced by or may be a tile, such as a floor tile which may be twelve inches by twelve, sixteen by sixteen, eighteen by eighteen, twelve by twenty-four, twelve by eighteen inches or any other size. The length L2 of the portion 102 of the plank 100*a*, shown in FIG. 3 (wherein the portion 102 has a layer 102*b* which includes a wear layer and a pattern layer) may be ⅜ of an inch less than the length L1. The width W2 of the portion 102 of the plank 100*a*, shown in FIG. 3 may be ⅜ of an inch less than the width W1 (shown in FIG. 2). Similarly the length L2 and the width W2 of the portion 103 shown in FIG. 4 may be each be ⅜ of an inch less than the length L1 and the width W1, respectively of the piece 100 shown in FIG. 2. Each of the slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 may have a width (typically shorter dimension) of 3/16 inches. Alternatively, the width of each slot (wherein the width of each slot is much smaller than the length of the respective slot), such as slot 104, may be 0.9 millimeters and the width of each rail (wherein the width of each rail is much smaller than the length of the respective rail), such as rail 105, may be 1.8 millimeters.

In at least one embodiment, the plank 100*a* has the same overall length L1 as the piece 100, however, the layer 102*b* (including a pattern layer or design layer) has a shorter length L2, due to the fact that some of the layer 101*b* of the piece 100 is removed in the process of forming the layer 102*b* and the plank 100*a* from the piece 100.

For forming the sides by altering the piece 100, such as sides 102*d-g* and 103*c-e* shown in FIGS. 3 and 4, respectively, a machine may be used which uses a blade which may in some embodiments be the most economical way to form the sides, such as sides 102*d-e* and 103*c-d*. The sides, such as sides 102*d-g*, and 103*c-f* may be formed from the piece 100 with various different angles to make a plurality of planks, such as a plurality of identical planks 100*a*, look like real hardwood, or make tiles looks like they have grouts. In one embodiment a deep and vertical cut can be made, so that the surface of one or more of sides 102*d-g* and 103*c-f* are at a ninety degree angle with respect to surface 102*a* and the surfaces 102*d-g* and 103*c-f* are even or flat. Creating a ninety degree angle between surface 102*a* and one or more of surfaces 102*d-g* and surfaces 103*c-f* is easier to control and operate.

Other ways can be used to create the sides of 102*d-g* and 103*c-f* (such as laser, waterjet, CNC, and sandy wheel.

The floor plank 100*a* may have different patterns on the surface 102*a* of the portion 102, such as wood, stone, carpet, etc, different colors such as white, green, red, multiple colors, etc., different finishes, such as different coatings and different surface textures, such as with embossing.

The thickness of wear layer, such as on surface 102*a* in FIG. 3, and the overall floor plank 100*a* thickness T1, shown in FIG. 3 may vary. In at least one embodiment, the thickness T1 of the overall plank 100*a* (which is typically the same as the thickness of the piece 100 of FIG. 2) may be much less than the overall length L1 and the width W1 of the floor plank 100*a* and of the piece 100. The base layer, such as most of body portion 102*c* and portion 103 may be a rigid backing or a foam backing. The backing or base layer (most of body portion 102*c* and portion 103 may have an anti-skid bottom texture on the surface 103*a* shown in FIG. 4.

FIGS. 7-10 show left side, right side, top, and bottom views of a floor plank 400 in accordance with another embodiment of the present invention. The floor plank 400 may be identical to or substantially the same as the floor plank 100*a* of FIG. 3, with some optional additions or modifications as will be described. The floor plank 400 may include a top portion 402 and a bottom portion 403 as shown by FIGS. 7-10. The floor plank 400 may include slots or channels 404, 406, 408, 410, and 412 which may be similar to or identical to slots or channels 104, 106, 108, 110, and 112 shown in FIG. 3 for floor plank 100*a*. The floor plank 400 may include rails 405, 407, 409, and 413 which may be similar to or identical to rails 105, 107, 109, and 113 shown in FIG. 3 for floor plank 100*a*. The floor plank 400 may also include grooves or further channels 406*a-b* and 404*a-b* shown in FIG. 9 and grooves or further channels 412*a-b*, and 416*a-b* shown in FIG. 10. The further grooves or channels 404*a-b*, 406*a-b*, 412*a-b*, and 416*a-b* may be added to the plank 100*a* to form a modified version of plank 100*a*. The further grooves or channels 404*a-b*, 406*a-b*, 412*a-b*, and 416*a-b* are used to allow excessive adhesive to flow into the further grooves or channels 404*a-b*, 406*a-b*, 412*a-b*, and 416*a-b*. The further grooves or channels 404*a-b*, 406*a-b*, 412*a-b*, and 416*a-b* are optional and depending on what kind of adhesive or cement is used, may or may not be useful or needed.

In accordance with a method and/or apparatus of an embodiment of the present invention a piece, such as piece 100 in FIG. 2, is produced and shaped through die cut and then sent to a machine to form the plank 100*a* of FIG. 3, such as to a bevel machine. In accordance with at least one embodiment of the present invention, the machine, such as a bevel machine, forms at least two sides of the top portion 102 shown in FIG. 3: one of the sides is a side running the length L2 of the plank 100*a*, such as side 102*d* or side 102*e*, and one of the sides is a side running the width W2 of the plank 100*a*, such as side 102*f* or 102*g*.

The process for producing the piece 100 of FIG. 2, prior to the forming, sculpting, cutting or beveling step may be a process which is known, such as, mass production thru die-cut or saw, or waterjet, which is typically used for special custom size or shape, for producing known vinyl tile/plank products. The piece 100 of FIG. 2 may have been shaped through a die-cut process.

In addition to forming at least two sides to form the top portion 102 in forming the plank 100*a*, at least one embodiment of the present invention includes forming at least two sides of the bottom portion 103, including at least one length wise, L2 side, such as either of sides 103*c* and 103*d*, and at least one widthwise side such as either of sides 103*e* and 103*f* shown in FIG. 4.

The step of cutting, beveling, etching, sculpting, carving, or chiseling out or otherwise removing various portions of the piece 100 of FIG. 2 to form the floor plank 100*a* of FIG. 3 may change the angle of a side, with respect to a neighboring top surface, such as the angle of side 2*d* with respect to top surface 2*a* from ninety degrees to another angle.

Figure 11A:
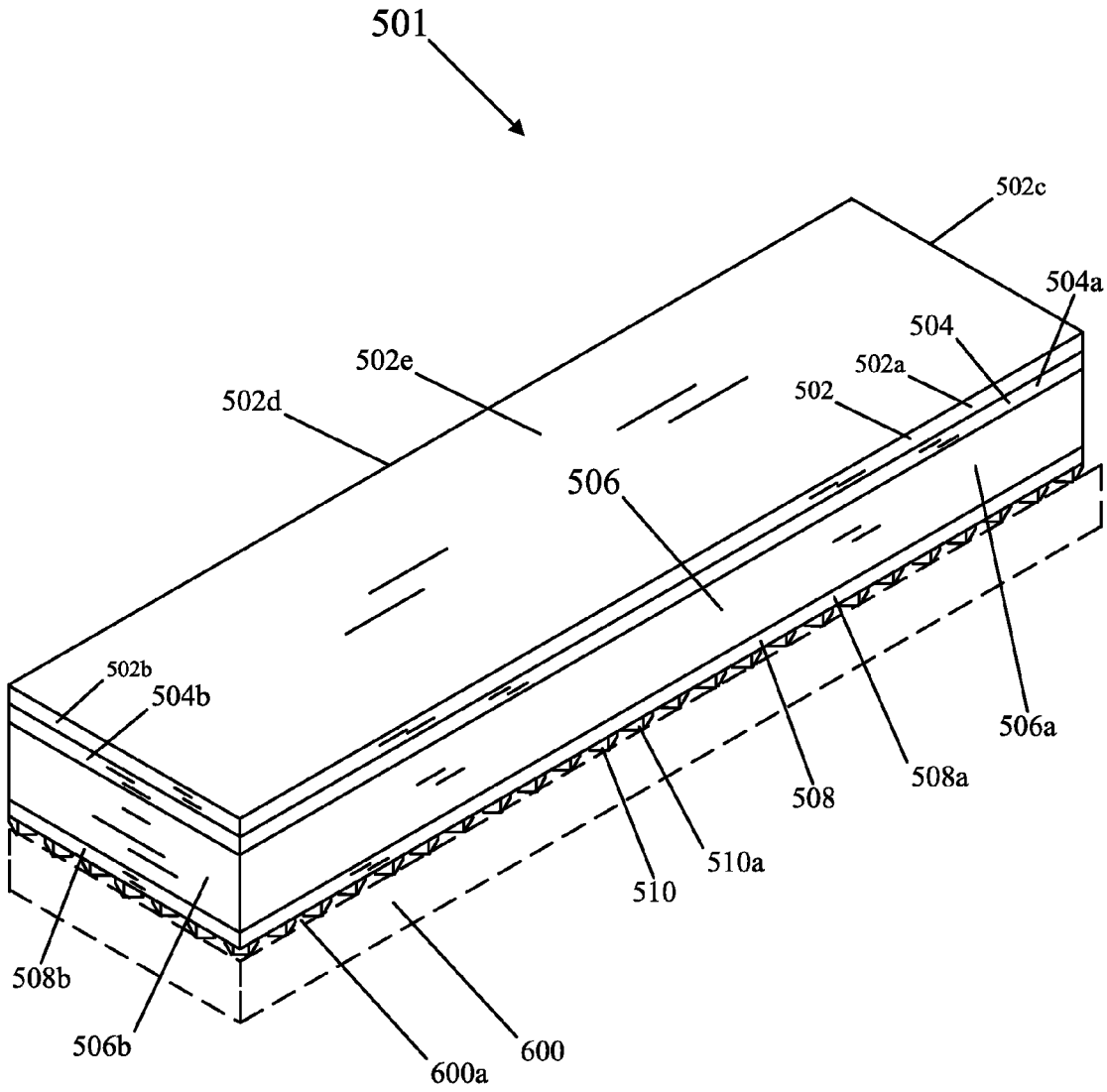
FIG. 11A shows a top, front, right side perspective view of a floor plank or tile in accordance with an embodiment of the present invention.
Figure 11B:
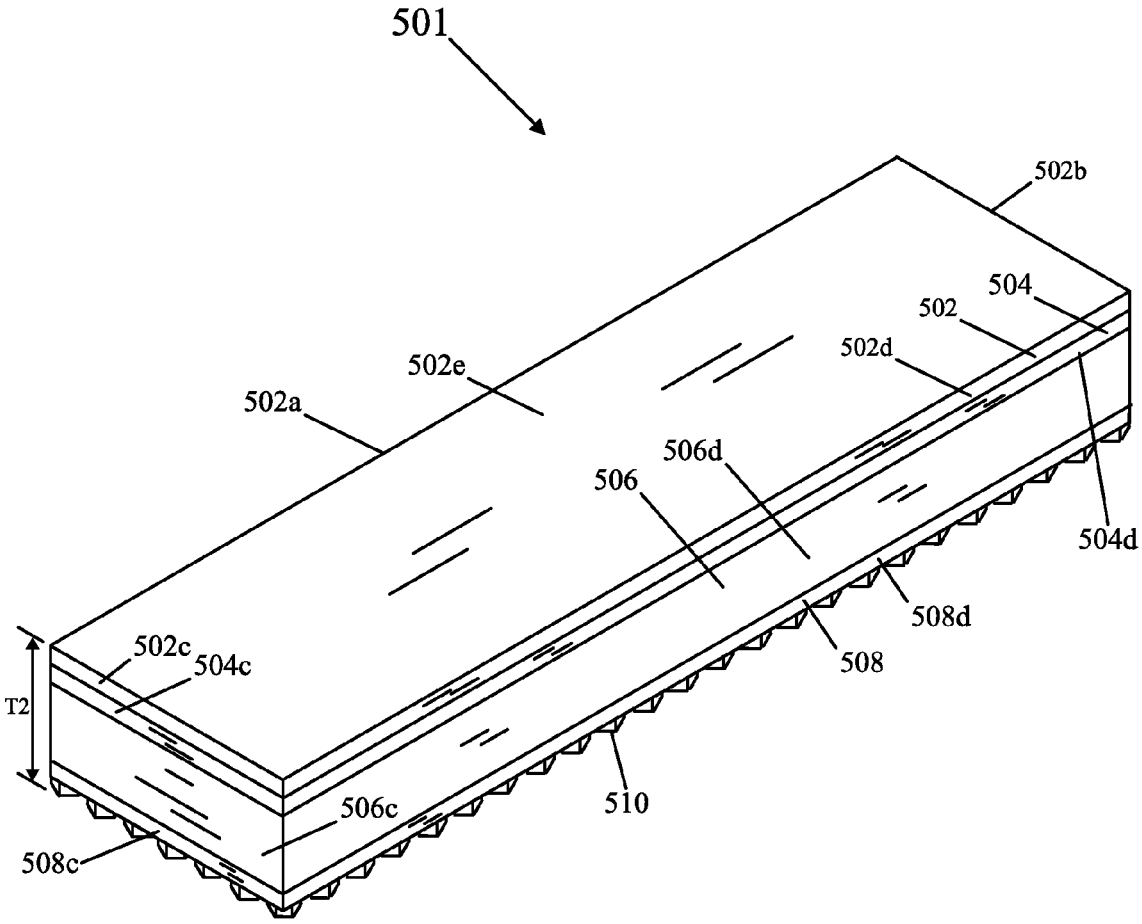
FIG. 11B shows a top, rear, left side perspective view of the floor plank or tile of FIG. 11A.
Figure 11C:
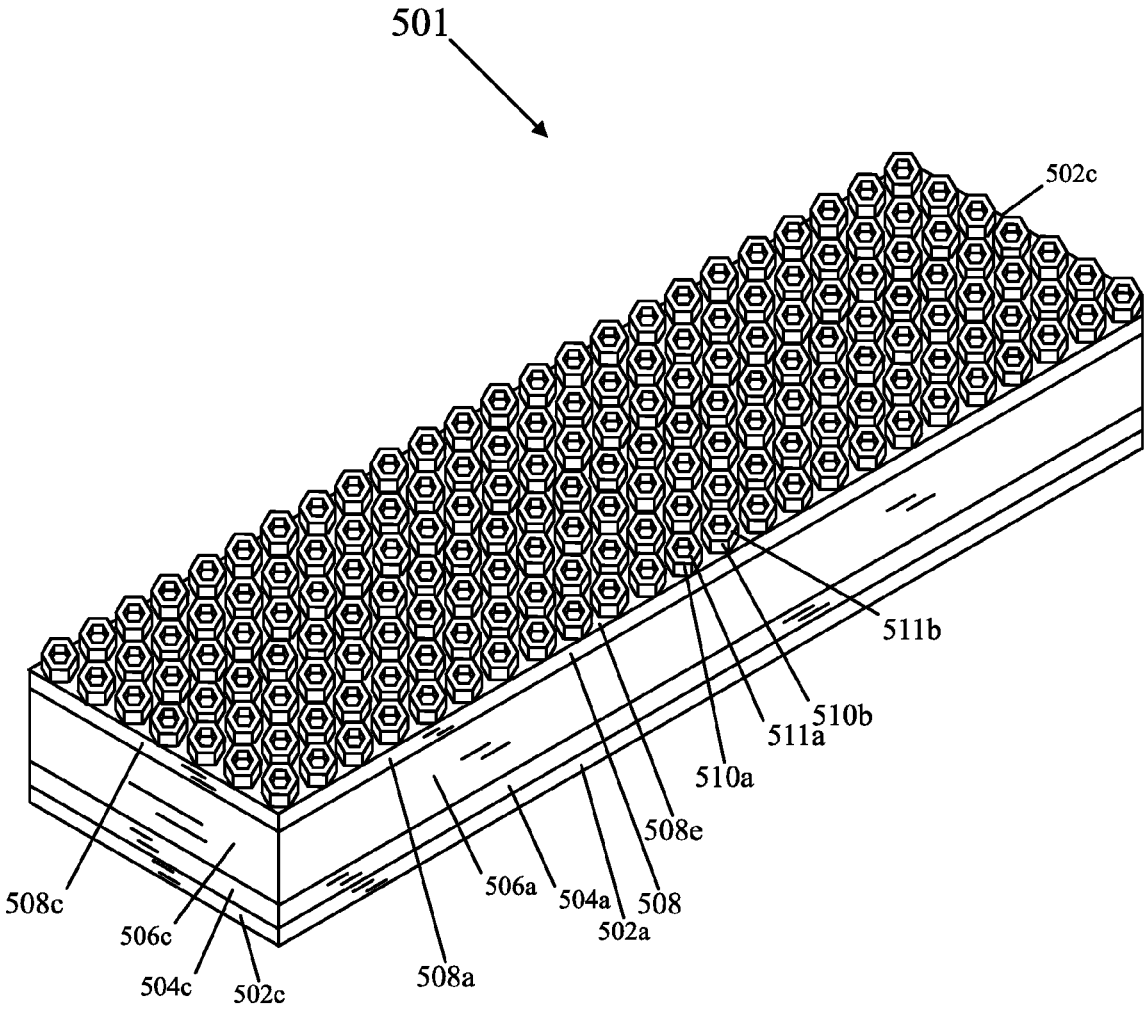
FIG. 11C shows a bottom, rear, right side perspective view of the floor plank or tile of FIG. 11A.
Figure 11D:
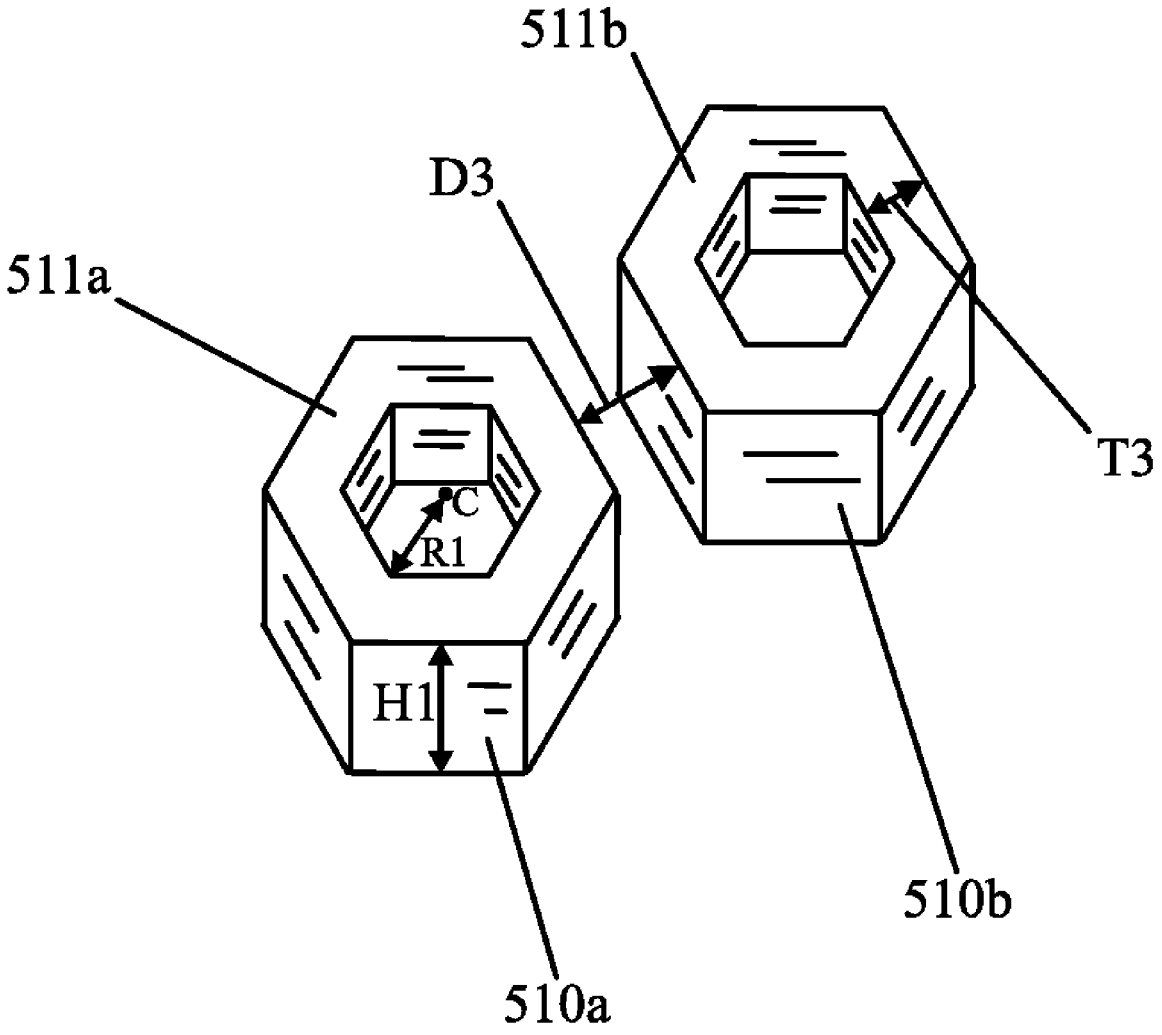
FIG. 11D shows a bottom rear right side perspective view of two protruding devices of a backing layer of the floor plank or tile of FIG. 11A.

FIG. 11A shows a top, front, right side perspective view of a floor plank or tile 501 in accordance with an embodiment of the present invention. FIG. 11B shows a top, rear, left side perspective view of the floor plank or tile 501 of FIG. 11A. FIG. 11C shows a bottom, rear, right side perspective view of the floor plank or tile 501 of FIG. 11A. FIG. 11D shows a bottom rear right side perspective view of two protruding devices 510*a* and 510*b* of a backing layer 508, of the floor plank or tile 501 of FIG. 11A.

Referring to FIGS. 11A-11D, the floor plank or tile 501 includes a wear layer 502, a pattern layer 504, a base layer 506, and a backing layer 508. The backing layer 508 includes a plurality of protruding devices or members 510, including device or member 510*a* and device or member 510*b* shown in FIGS. 11A-11C. The protruding devices or members 510 may be replaced by indentation devices or grooves, each groove or indentation device having a shape similar to members 510*a* or 510*b*.

The floor plank 501 may be considered to be a piece or may be formed from a piece in accordance with an embodiment of the present invention.

The wear layer 502 includes a right side 502*a*, a front 502*b*, a rear 502*c*, and a left side 502*d* as shown by FIGS. 11A and 11B. The pattern layer 504 includes a right side 504*a*, a front 504*b*, a rear 504*c*, and a left side 504*d* as shown by FIGS. 11A and 11B. The base layer 506 includes a right side 506*a*, a front 506*b*, a rear 506*c*, and a left side 506*d* as shown by FIGS. 11A and 11B. The backing layer 508 includes a right side 508*a*, a front 508*b*, a rear 508*c*, and a left side 508*d* as shown by FIGS. 11A and 11B.

The wear layer 502 may include any known wear layer. The wear layer 502 may be substantially made of PVC (Polyvinylchloride).

The pattern layer 504 may include any known pattern layer. The pattern layer 504 may be printed on a white-based PVC (Polyvinylchloride) film, or on the back of a transparent PVC film.

The wear layer 502 may be a thin transparent layer. The pattern (or design) layer may be a thin design layer, such as a synthetic wood grain design layer or a polyvinyl chloride (PVC) synthetic wood grain design layer or a polypropylene synthetic wood grain design layer.

In accordance with an embodiment of the present invention, the base layer 506, may include a filler made of ilmenite powder, and in another embodiment may include a filler made of ilmenite powder and calcium carbonate. The base layer 506 may be made of a mixture of filler (such as a filler comprised of ilmenite powder and calcium carbonate), PVC (polyvinyl chloride), a plasticizer, and other additives, such as a stabilizer, such as carbon black, DOA, or rosin. These may be the only components or ingredients of base layer 506.

In at least one embodiment, for a batch of material for base layer 506, a batch may be made of a mixture of fifty kilograms (kgs) of virgin PVC, seventy-five kilograms (kgs) of ilmenite powder, sixty kilograms (kgs) of calcium carbonate, 0.45 killograms (kgs) of carbon black, 0.3 kilograms (kgs) of rosin (or resin oil), 0.75 kilograms (kgs) of stabilizer, five kilograms (kgs) of DOA, and thirty-five kilograms (kgs) of DINP.

If virgin PVC is used (i.e. not recycled PVC) then the ratio of PVC to filler by weight may range from 1.0 to 1.0 at one end of a first range to 1.0 to 1.3 at the other end of the first range. I.e. at one end of the first range, for every one gram of filler there may be one gram of PVC and at the other end of the first range, for every one gram of PVC there may be 1.3 grams of filler.

If recycled PVC is used then the ratio of recycled PVC to filler by weight may range from 1.0 to 1.0 (1:1) at one end of a second range to 1.0 to 2.0 (1:2) at the other end of the second range. I.e. at one end of the second range, for every one gram of recycled PVC there may be one gram of filler and at the other end of the second range for every one gram of recycled PVC there may be two grams of filler. The filler may be substantially or entirely made of ilmenite powder. The filler may be made of ilmenite powder and calcium carbonate, or may contain little or no calcium carbonate and substantially or only ilmenite powder.

However, it should be noted that recycled PVC typically includes within it an amount of filler, wherein the filler in the recycled PVC may include calcium carbonate, however the particular type of filler in the recycled PVC depends on which industry the recycled PVC is from. However, in one or more embodiments, the content of PVC in recycled PVC is less than virgin PVC because recycled PVC may be a mix of calcium carbonate and PVC. If recycled PVC is used, the ratio of recycled PVC to calcium carbonate may be 1:0 (i.e. no calcium carbonate) at one end of a range to 1:1 at another end of a range.

For at least one embodiment of the present invention, the plank/tile 501 has to smoothly contact the underlayment or subfloor or surface 600*a* of FIG. 11A. Therefore, for at least one embodiment of the present invention, we may use higher contents of virgin PVC for the base layer 506, for example 1.0 to 1.0 (1:1) at one end of a third range to 1.0 to 2.5 (1:2.5) at another end of the third range. I.e. at one end of the third range, for every one gram of virgin PVC there may be 1.0 grams of filler and at the other end of the third range, for every one gram of virgin PVC there may be 2.5 grams of filler.

The filler of the base layer 506, in accordance with one embodiment of the present invention, is made of a mixture of ilmenite powder and calcium carbonate and may be made of only ilmenite powder. The ratio of ilmenite powder to calcium carbonate may be about 1.25 to 1.0 (1.25:1). I.e. for every one and a quarter grams of ilmenite powder there may be one gram of calcium carbonate. A mixture of calcium carbonate and ilmenite powder is used, for at least the reason, that calcium carbonate is less expensive than ilmenite powder. The actual formula may change subject to the quality of raw materials used for the base layer 506, the temperature of the season, and the request of customer. For example, for request of customer, the customer may want greater hardness, a different type of flexibility, or a different type of overall tile/plank thickness, and these may affect the percentages of raw materials or materials used for the base layer 506.

For the base layer 506, in at least one embodiment, all raw materials which may include filler (such as a filler comprised of ilmenite powder and calcium carbonate), PVC (polyvinyl chloride), a plasticizer, and other additives may be mixed together and heated in a mixer, such as a Banbury mixer for pre-plasticization, to form an overall mixture. A Banbury mixer as known in the art is an internal mixer produced by Farrel Corporation, used for mixing or compounding plastics and interspersing reinforcing fillers in a resin system.

After the overall mixture is formed by the mixer, such as a Banbury mixture, the overall mixture may be sent to sets of rollers or to a calendering machine to produce the base layer 506. The wear layer 502, pattern layer 504, and base layer 506 may then be laminated together with a hot press machine. The base layer 506 material may need to be cut before lamination to fit the size of the hot press machine. Some factories can also laminate by using extruder or calendering machine, they don't have to cut the base layer 506 immediately but can automatically and continuously go on producing.

It is known to make a floor plank or tile with a filler including iron powder and calcium carbonate. However, ilmenite powder is not known for use in a base layer for a floor plank or tile. Using ilmenite powder in accordance with an embodiment of the present invention for a floor plank or tile, such as floor plank or tile 501, is better than using iron powder for several reasons. Firstly, ilmenite powder is as not sensitive to temperature, as iron powder is, which means that ilmenite powder is less likely to expand and contract than iron powder, and therefore a floor plank or tile, such as floor plank or tile 501 made of a base layer including ilmenite powder is less likely to expand and contract than a floor plank or tile make of iron powder.

Secondly, ilmenite powder is better than iron powder for keeping dimensional stability of a floor plank, meaning that the floor plank or tile 501 is less likely to expand or contract with ilmenite powder used for the base layer 506 than with iron powder. Expansion or contraction of the floor plank or tile 501, after installation on a floor surface such as 600*a*, may change size (or even shape) of floor plank or tile 1, and would be a problem for end-user, reseller or installer. Generally, contraction or expansion of a floor plank or tile, even before or during installation may cause problem because not every piece will expand or shrink to a same size.

Thirdly, Ilmenite powder has anti-oxidization properties that are better than iron powder, which means that ilmenite powder is less likely to rust than iron powder (also, a rusted iron may have bad smell). Fourthly, Ilmenite powder typically costs less than iron powder. Fifthly, for a floor plank or tile, such as 501, of an embodiment of the present invention, which can be used, and is used in at least one embodiment, without applying adhesives to the bottom surface 508*e* of the backing 508 or to the outer surfaces 511*a* and 511*b* and other outer surfaces of the plurality of devices 510, it is desirable to make the floor plank or tile 501 heavier. Increasing the weight of the floor plank or tile 501, makes it more difficult for the floor plank or tile 501 to move when placed on a floor surface, such as surface 600*a* of floor 600 in FIG. 11A. Ilmenite powder is heavier than iron powder, so a combination of ilmenite powder and calcium carbonate is heavier than a combination of iron powder and calcium carbonate. In at least one embodiment of the present invention, the mixing percentage of ilmenite powder and calcium carbonate can be adjusted to make a heavier plank.

In at least one embodiment of the present invention using ilmenite instead of iron, allows a plank or tile 1 to be made which uses 10% to 20% more calcium carbonate in the base layer 506 than in iron powder—calcium carbonate base layers of the prior art. With the same weight of ilmenite or iron, it is possible to put more calcium carbonate in the base layer 506, which means less PVC can be put in the base layer 6 compared with PVC in base layers of the prior art, so we can save cost and increase weight. Due to the use of ilmenite, we can use more calcium carbonate. The unit price of calcium carbonate is typically much lower than ilmenite powder, iron powder, or PVC, or most if not all of the components used in the base layer 506. In contrast, in the known prior art, floor planks or tiles are made as light as possible to keep down costs of transporting the floor planks and tiles. In the known prior art light calcium carbonate is used, whereas in at least one embodiment of the present invention "heavy" calcium carbonate is used. Typically there are two types of calcium carbonate. One is light weight or "light" calcium carbonate, which may be used for the base layer 506 of an embodiment of the present invention, and; another is heavy weight or "heavy" calcium carbonate, which is commonly used in paint or other industries. but which is typically not used for base layer 506 or for base layers of floor planks or tiles of the prior art. It is possible, that heavy weight or "heavy" calcium carbonate may be used for a base layer 506 in an alternative embodiment of the present invention.

The base layer 506, in accordance with an embodiment of the present invention also may include an additional plasticizer, which may be made of 5% DOA (Bis(2-ethylhexyl) adipate) and 95% DINP (Di-isononyl phthalate) and which may be used in PVC in the base layer 506 as a plasticizer. This particular plasticizer has low temperature resistance and may create better flexibility for the base layer 506, than using DINP (Di-isononyl phthalate) alone, which is typically done for known base layers for known planks and tiles. In at least one embodiment of the present invention, the base layer 506 may be made of PVC, ilmenite powder, calcium carbonate, DOA, a plasticizer (such as DINP, typically used in the PVC), lubricant and some other additives.

The plasticizer used for the base layer 506 may be a Flexidone plasticizer (instead of DINP) from International Specialty Products Inc., (ISP), located in Wayne, N.J., (internet address: ispplastics.com). These Flexidone plasticizers are typically based on N-alkyl pyrrolidone chemistry.

The backing layer 508 may have a bottom surface 8*e* shown in FIG. 11C. An anti-slip backing film, such as made of Polyurethane (PU), may be located on the bottom surface 508*e*. An anti-slip backing film, such as made of Polyurethane (PU), may also be located on the outer surfaces of the protrusions or devices 510, such as on the outer surfaces 511*a* and 511*b* of the devices 510*a* and 510*b*, shown in FIGS. 11C and 11D. The anti-slip backing film may be laminated on the bottom surface 508*e* and the outer surfaces 511*a* and 511*b*, and similar outer surfaces of each of the plurality of devices 510.

In at least one embodiment of the present invention, in order to form the plank or tile 501 of FIGS. 11A-C, an anti-slip PU film may be placed between the base layer 506 and an embossing plate for (lamination all components together and create honeycomb texture) a honeycomb design (i.e. the configuration of hexagonal shapes shown in FIG. 11C) In such an embodiment, the anti-slip PU film may cover outer surfaces 511*a* and 511*b* and other outer surfaces of the devices 510 shown in FIG. 11C, and the anti-slip PU film may come between the base layer 506 and the backing layer 508. In such an embodiment, the anti-slip film may entirely surround the backing layer 508 and the devices 510. The backing layer 508 and the devices 510, surrounded by an anti-slip film may be sent to a hot press machine with the base layer 506 to laminate the backing layer 508 onto the base layer 506, with the anti-slip film between the base layer 506 and the backing layer 508 and surrounding the devices 510. The anti-slip film may be considered to be integrated with the backing layer 508, i.e. part of the backing layer 508. The honeycomb texture, for example in FIG. 11C, the devices 510 shown protruding from the backing layer 508, may be created through heat. In at least one embodiment, the anti-slip film thus covers every part of the honeycomb.

It is known in the art to place PVC film on a bottom surface of a floor plank or tile, in order to keep the floor plank or tile flat, to prevent cupping or pillow-up, and also to isolate moisture from an underlayment or subfloor. However, PVC film was not typically used to provide an adhesive free anti-slip surface. It is known in the art to use PU (polyurethane) on the top surface of a floor plank or tile, for the purpose of durability and easy cleaning.

In at least one embodiment of the present invention, PU (polyurethane) is better than PVC for use as an anti-slip film to surround the backing layer 508 and the devices 510, because PU is more environmentally friendly and is better at preventing moisture buildup. In at least one embodiment a PU anti-slip film surrounding the backing layer 508 and the devices 510 isolates moisture coming from the underlayment or subfloor, under a floor plank or tile, such as under floor plank or tile 501 of FIGS. 11A-C, and thereby prevents moisture from seeping into the base layer 506. If moisture is allowed to seep into the base layer 506, it may be absorbed by the calcium carbonate and may harm the quality of the floor plank or tile 501.

Instead of PU, the anti-slip backing film placed on the bottom surface 508*e* and on the outer surfaces of each device or devices 510, such as outer surfaces 511*a* and 511*b*, may be an aluminum oxide infused Polyurethane, a synthetic rubber, a plastic, or a material embedded with carborundum, however PU anti-slip film is preferred particularly in combination with ilmenite powder filler for the base layer 506 and honeycomb bottom texture or devices 510 for the backing layer 508. However, for other types of base layers or backing layers, other types of anti-slip backing films may be better. For example, for rubber floor base layers or replace all of layers 502, 504, and 506 with rubber (to rubber tile, base layer 506 typically has to be rubber or rubber synthetics0. Layer 502 & 504 can still be PVC or other plastic synthetics. A rubber floor sometimes does need layers, similar to layers 502 and 504. A rubber floor can be solid-colored or simply spread pigment in solid-colored base to create random pattern, by for example spreading colorful chips through the rubber material. Synthetic rubber for an anti-slip film may be better than PU, in one or more embodiments.

Each of the plurality of devices 510 may have the same, or substantially the same, hexagonal, six sided shape, as shown by FIGS. 11C and 11D. The plurality of devices 510 may be arranged in a honeycomb configuration as shown by FIG. 11C. As shown in FIG. 11D there may be a distance of D3 between devices 510*a* and 510*b*. Similarly there may be a distance of D3 between each of the plurality of devices 510 and any adjacent device of the plurality of devices 510. Each of the plurality of devices 510 may have a height H1 which may be 0.1 mm (millimeters) to 0.3 mm (millimeters). Each of the plurality of devices 510 may have six walls making up the hexagonal shape, and the thickness T3 of each of the walls of each of the devices 510 may be in a range of 0.30 millimeters (mm) to 1.0 millimeters (mm), or wider or narrower in some cases. For at least one embodiment of the present application, about 0.35 millimeters are used for the thickness T3, in a range of plus or minus +/−0.05 millimeters. The hexagonal shape may be delineated by a regular hexagon having a center C and a radius R1 as shown in FIG. 11D, which may be about 3.0 mm (millimeters) to 5.0 mm (millimeters). D3 may be zero because hexagonal shapes may be connected together. However, D3 may be some non-zero value, such that there is separation between adjacent hexagonal structures, such as between device 510*a* and 510*b* in FIG. 11D. It is known in the art to have circles or circular protrusions on the bottom of a floor plank or tile. However the hexagonal shape of each of devices 510 and the honeycomb configuration of an embodiment of the present invention, as shown in FIG. 11C, have been found to have better anti-slip performance, than the known configuration of circles. The outer surfaces 511*a* and 511*b* (shown in FIG. 11D) and similar outer surfaces of each of the plurality of devices 510, help the floor plank or tile 501 to frictionally contact a top floor surface of a floor, such as a top floor surface 600*a* of a floor 600, shown in dashed lines in FIG. 11A. In FIG. 11A, the outer surfaces of the devices 510, such as outer surfaces 511*a* and 511*b*, shown in FIG. 11C, and similar outer surfaces, contact the top surface 600*a* of the floor 600. As previously described there may be an anti-slip film on the outer surfaces 511*a* and 511*b*, such that the anti-slip film actually comes in contact with the top surface 600*a* of the floor 600.

Typically a cutting die would be used to form the edges of the floor plank or tile 501, such as edges at the front 502*b*, right side 502*a*, rear 502*c*, and left side 502*d*, shown in FIG. 11B. The floor plank 501 may be in the form of a conventional known plank or tile.

The base layer 506 may be made in advance by calendering (sophisticated, base layer will be thin) or by sets of rollers (simple, base layer will be thicker). The wear layer 502, pattern layer 504 and base layer 506 may then be properly aligned, so that each layer has substantially the same length and width, is aligned with the other layers, and does not extend substantially beyond the other layers. After cutting, the aligned layers 502, 504, and 506 may then be sent to a hot press machine for lamination to add the backing layer 508 and the devices 510.

A cutting die can be installed with a calendering machine or extrusion machine, so the entire production process may be made to be automatic and continuous. But due to technique bottleneck or budget limit, factory can also cut lamination sheet into slab, then send to independent, or standoff, cutting die to shape into piece or floor plank or tile 501.

The wear layer 502 is transparent, and typically has a thickness of from 0.03 millimeters to 1.2 millimeters. The base layer 506, can itself be comprised of more than one layer, such as one, two, or three layers, typically depending on the thickness T2 of the plank or tile 501, shown in FIG. 11B. Although the base layer 506 may be comprised of more than one layer, it will still appear to be one layer, because any multiple layers of the base layer 506 will be laminated together, unless the layers are different colors.

The wear layer of the layer 504 of the plank, tile or piece 501, may be pure PVC, with greater pulling power (upward) when temperature goes down (for example, a relatively higher processing temperature versus relatively lower room temperature), and for such a PVC wear layer, typically a balance layer as part of the base layer 506 of the plank, tile or piece 501 is used to offset the pulling power of the wear layer 504. A leveling layer or in this case the devices 510 (and anti-slip surface) of the base layer 506 of the floor plank or tile 501, would be the bottommost layer and is placed in contact with a subfloor or underlayment surface 600*a* of subfloor 600, shown by dashed lines in FIG. 11A.

A fiber glass layer may optionally be placed between the pattern film layer 504 at the bottom and the base layer 506 (or may be placed between a leveling layer and balance leveler), however alternatively, fiber glass materials can be mixed in with the base layer 506 of the floor plank 501. Fiber glass materials mixed in with the base layer 506.

For the lowest (price wise) end product for residential uses, a pattern may be printed on the back of the wear layer 502, then a pure white film may be paved underneath the pattern (on the non-pattern side) layer 504, which is called a "feature layer/film". The combination wear layer 502 (with pattern on back) and "feature layer/film" may then be laminated onto a base layer 506, and thereafter a large slab or sheet including the combination wear layer 502 and the base layer 506 may be die cut to form a plurality of pieces each identical or similar to piece or floor plank 501. For better anti-scratch, anti-cuff and better durability of the surface or top 502*e* shown in FIG. 11A, a coating may be spread on top of the surface or top 502*e*, such as a polyurethane coating. A coating of silicone, Teflon, or epoxy and other types of coatings may also be used on the surface 502*e*.

On the back of the floor plank or tile such as on outer surfaces 511*a* and 511*b* shown in FIG. 11C, there is typically a need to provide protection from moisture from the subfloor or underlayment 600 under the tile/plank 501.

The base layer 506, following cutting away portions of a raw material piece to form the plank 1 may be comprised of one or more of the following materials: polyvinyl chloride (PVC), calcium carbonate (filler), DOP or DINP, a lubricant, a stabilizer, and/or various additives. DOP (Dioctyl Phthalate) is a combustible non-toxic colorless oily liquid with slight odor. Disononyl phthalate (DINP) has similar functions and properties as DOP but is more environmental-friendly. The lubricant may be resin oil or rosin. The wear layer 502, the pattern film layer 504, and the base layer 506 may be laminated to each other through heat (can also be laminated by adhesive or cement). The plank 501 of FIGS. 11A-D, may be initially formed by being die cut from a raw material piece. However, in accordance with an embodiment of the present invention a raw material piece is not die cut in order to modify a raw material piece into the plank 501.

Instead of die cutting to initially form a raw material piece, another method such as water jet, and CNC, Computer numerical control, which utilizes the commands of numerical control program (compiled by computer) to drive a motor of machine can be used.

Figure 12:
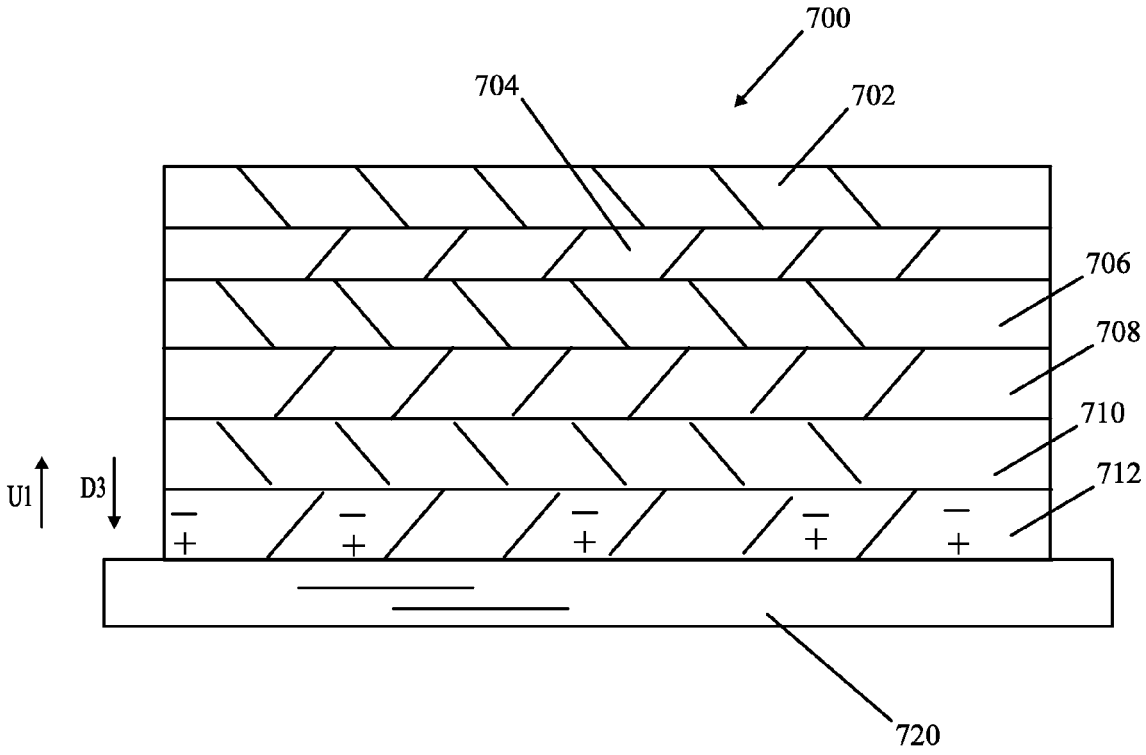
Fig. 12 (Prior Art)
FIG. 12 shows a cross sectional diagram of a floor plank in accordance with the prior art.

FIG. 12 shows a cross sectional diagram of a floor plank or tile 700 in accordance with the prior art. The floor plank or tile 700 includes an optional coating 702, a wear layer 704, a pattern film 706, a first base layer 708, a second base layer 710, and a magnetic base layer 712. The magnetic base layer 712 may be substantially or entirely comprised of a magnetic material which can magnetically attach itself to a floor or subfloor 720. The floor or subfloor 720 may be made of iron or another metal which is attracted to the magnetic material of magnetic base layer 712.

In the prior art diagram of FIG. 12, the magnetic base layer 712 is shown with "–" and "+" symbols to indicate the direction of polarity of the magnetic field or magnetic polarity in magnetic base layer 712. The magnetic polarity of the layer 712 is oriented so that the polarity either goes up in the direction U1 or down in the direction D1, and thus is attracted to the floor 720. It is also known to make the floor 720 magnetic and make the layer 712 iron or iron powder.

Figure 13:
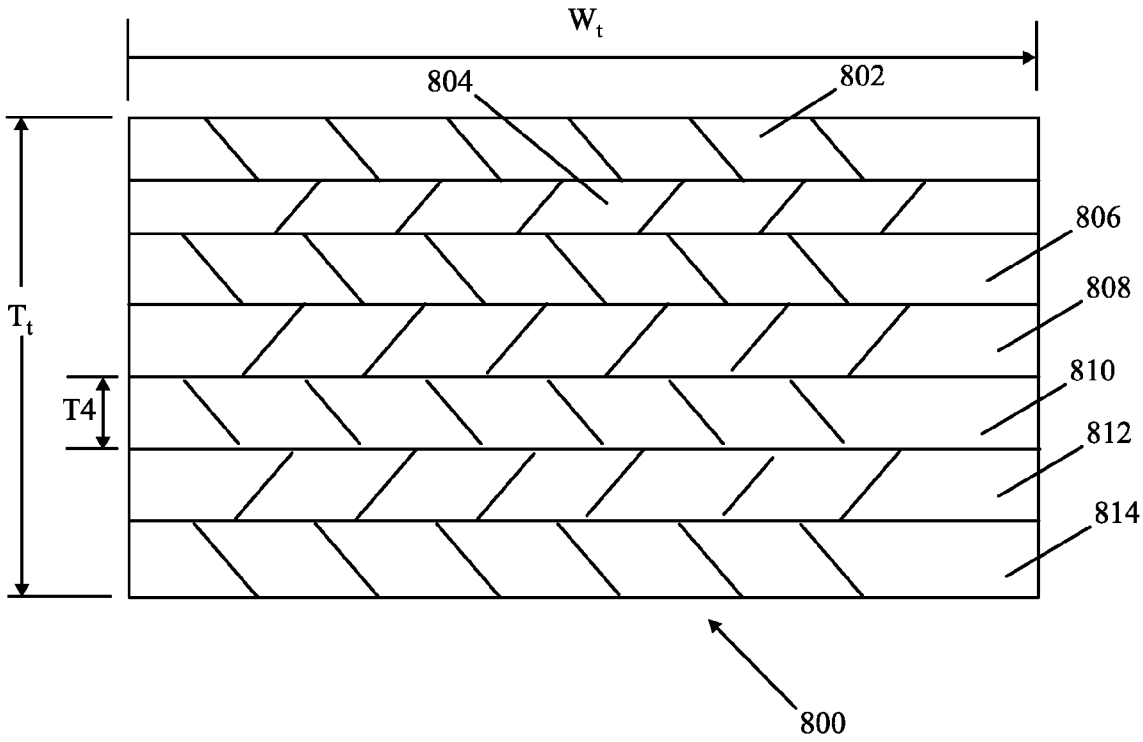
FIG. 13 shows a cross sectional diagram of a floor plank in accordance with an embodiment of the present invention.

FIG. 13 shows a cross sectional diagram of a floor plank 800 in accordance with an embodiment of the present invention. The floor plank 800 may be a floor plank or tile or other piece of a flooring or floor. The floor plank 800 includes an optional coating 802, a wear layer 804, a pattern film 806, a first magnetic base layer 808, a second magnetic base layer 810, a third magnetic base layer 812, and an anti-slip PVC/PU film (anti-moisture backing) layer 814. In some embodiments of the present invention, the floor plank or tile 800 may only include one (such as 808, but not 810 or 812) or two (such as 808 and 810 but not 812) magnetic base layers, instead of three as in FIG. 13. In some embodiments of the present invention, the floor plank or tile 800 may have more than three magnetic base layers. The number of magnetic layers provided may depend on the type of machine used to produce base layers.

Each of the magnetic base layers, such as layer 810 may have a thickness or depth T4 which may range from 0.25-0.75 millimeters. Alternatively only one magnetic base layer (such as one of layers 808, 810, and 812) can be provided and may have a depth T4, which may be between 0.25 and 0.75 millimeters.

Each of the magnetic base layers, such as each of layers 808, 810, and 812 shown in FIG. 13 may be a flexible magnetic sheet, which may be known for other purposes. For example, each of magnetic base layers 808, 810, and 812 may be a flexible magnetic sheet produced by Qualita Magnetics (Shenzhen) Ltd. from Guangdong, China. A flexible magnetic sheet for any of layers 808 and 810 may include or be substantially or entirely comprised of a ferrite magnet material or a rubber magnet material. Such magnetic sheets typically have strong magnetism, and are provided in rolls or cut sheets. Such magnetic sheets may be used for refrigerator magnets, magnetic car signs, and promotional products. These magnetic sheets are easy to die cut and meet international material safety standards. These magnetic sheets may be NdFeB (neodymium) permanent flexible magnetic sheets. Rare earth NdFeB flexible magnetic sheets are the strongest isotropic flexible magnet in the world, they are of high energy, a Max. BH of 90 KJ/m$^3$ (11.25 MGO) is available at laboratory, five times more than that for Ferrite magnetic strip, quite close to the highest property of compression molded NdFeB ring magnet, magnetic property for industrial batch quantity ranges from 16 to 68 KJ/m$^3$ (2.0-8.5 MGO).

Figure 14:
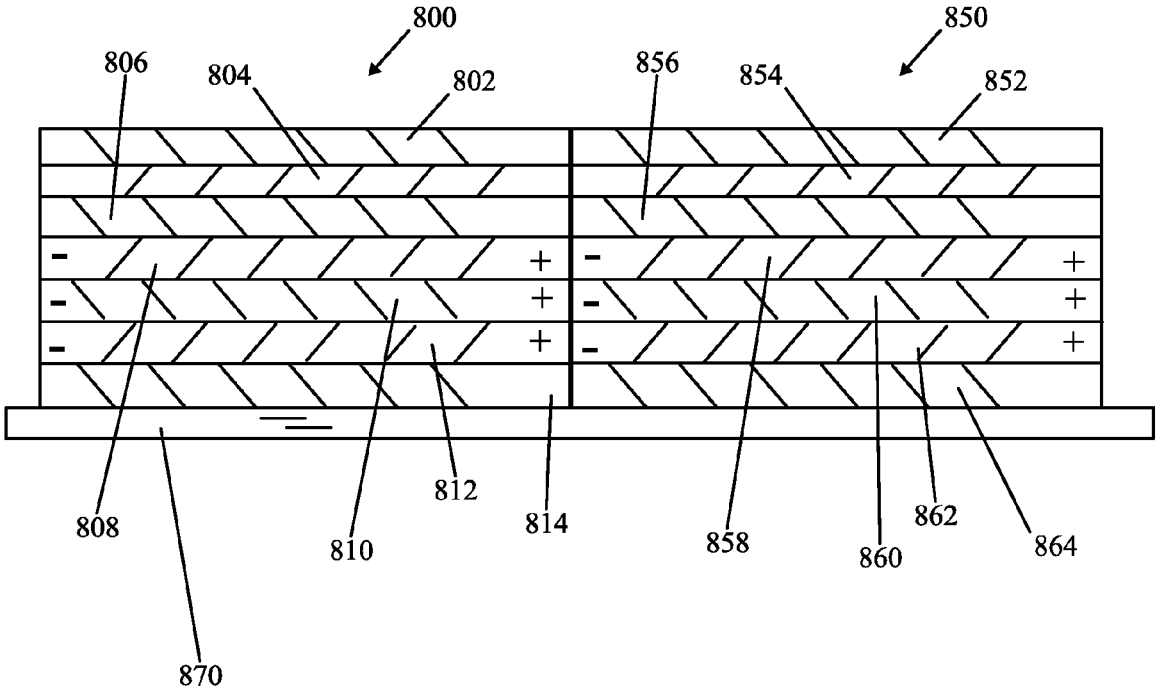
FIG. 14 shows a cross section diagram of two floor planks in accordance with an embodiment of the present invention, placed side by side on a floor or subfloor surface.

FIG. 14 shows a cross section diagram of two floor planks 800 and 850 in accordance with an embodiment of the present invention, placed side by side on a floor or subfloor 870. The floor plank 850 may be identical to or substantially the same as the floor plank 800. The floor plank 850 includes an optional coating 852, a wear layer 854, a pattern film 856, a first magnetic base layer 858, a second magnetic base layer 860, a third magnetic base layer 862, and an anti-slip PVC/PU film (anti-moisture backing) layer 864. In some embodiments of the present invention, the floor plank or tile 850 may only include one (such as 858, but not 860 or 862) or two (such as 858 and 860 but not 862) magnetic base layers, instead of three as in FIG. 14. In some embodiments of the present invention, the floor plank or tile 850 may have more than three magnetic base layers.

Figure 15:
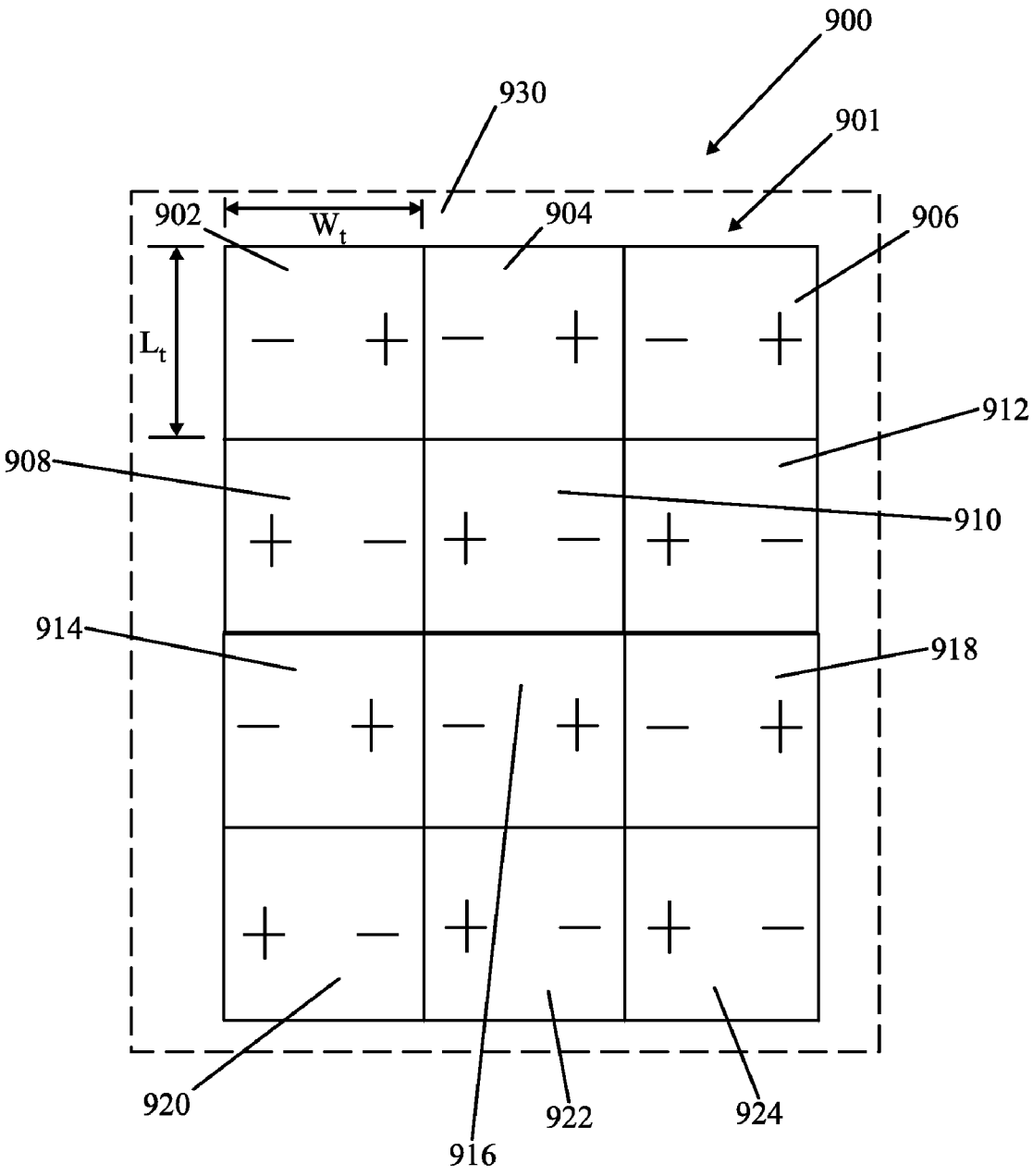
FIG. 15 shows a simplified top diagram of a plurality of floor planks or tiles in accordance with an embodiment of the present invention laid on a floor or subfloor.

Each of floor planks 800 and 850 may have a length, width, and a depth. Each of floor planks 800 and 850 may have a rectangular or square appearance as viewed from the top as shown for example in FIG. 15, for floor plank or tile 902. Each of floor planks 800, 850, and 902 may have a width $W_t$ and a Length $L_t$ as shown in FIG. 15, and a thickness $T_t$ as shown in FIG. 13 so that the width $W_t$ is substantially greater than the thickness $T_t$ and the length $L_t$ is substantially greater than the thickness $T_t$. The diagram in FIG. 13 has been exaggerated in thickness to show the various layers of the floor plank 800, however, the thickness $T_t$ is typically substantially much less than the width $W_t$ and substantially much less than the Length $L_t$. For example the width $W_t$ may be twelve inches, the length $L_t$ may be twelve inches, while the thickness $T_t$ may be one half an inch or less depending on the application.

As shown by FIG. 15, the floor plank 902 in FIG. 15 (and also the floor planks 800 and 850) may have a magnetic north pole (indicated by "+" sign) running along the length $L_t$ of the floor plank 902, and at a first end of the floor plank 902. The floor plank 902 may have a magnetic south pole (indicated by "–" sign) running along the length $L_t$ of the floor plank 902, at a second end of the floor plank 902, which is opposite the first end of the floor plank 902.

The floor planks 800 and 850 are placed on a floor or subfloor 870, so that the anti-slip PVC/PU film layers 814 and 864 are in contact with the floor or subfloor 870, and so that corresponding layers of the floor planks 800 and 850 are aligned with each other. Optional coating 802 is aligned with and adjacent to optional coating 852; wear layer 804 is aligned with and adjacent to wear layer 854; pattern films 806 and 856 are aligned with and adjacent to one another; first magnetic base layers 808 and 858 are aligned with and adjacent to one another; second magnetic base layers 810 and 860 are aligned with and adjacent to one another; third magnetic base layers 812 and 862 are aligned with and adjacent to one another; and PVC/PU film layers 814 and 864 are aligned with and adjacent to one another.

In FIG. 14 the magnetic polarity of the magnetic base layers 808, 810, 812, 858, 860, and 862 is represented by the use of a "–" symbol to represent a magnetic south pole, and a "+" symbol to represent a magnetic north pole. The floor planks 800 and 850 have been aligned in FIG. 14 so that the north poles of the floor plank 800 are immediately adjacent the south poles of the floor plank 850. In this manner the floor planks 800 and 850 are attracted to one another and held magnetically together.

FIG. 15 shows a simplified top diagram 900 of a plurality 901 of floor planks or tiles in accordance with an embodiment of the present invention laid on a floor or subfloor 930 (shown by dashed lines). The plurality 901 of floor planks or tiles may include floor planks or tiles 902, 904, 906, 908, 910, 912, 914, 916, 918, 920, 922, and 924. Each of the plurality 901 of floor planks may be similar to or identical to the floor plank 800 or 850 shown in FIGS. 13 and 14. Each of the plurality 901 of floor planks may have one or more magnetic layers and the magnetic polarity of the one or more magnetic layers is represented by "–" and "+" symbols shown in FIG. 15. The plurality 901 of floor planks are laid down so that the positive magnetic poles are adjacent to the negative magnetic poles, so that these opposite poles attract and the floor planks 901 are held together. For example, floor plank 902's positive or north pole is laid down next to floor plank 904's negative pole and floor plank 908's negative pole.

The magnetic base layers, such as 808, 810, and 812 may be purchased from various sources. The magnetic base layers, such as 808, 810, and 812, may be made substantially of or entirely of iron powder or inmenite powder. An impulse magnetizer machine, known in the art, can be used to make the iron powder or inmenite powder magnetic or give the iron powder or inmenite powder its magnetic polarity. The impulse magnetizer machine can be used before or after the base layers 808, 810, and 812 are laminated as part of the floor plank 800. An "IMPULSE MAGNETIZER T-SERIES" from "MAGNET-PHYSICS INC." can be used to create the magnets or magnetic polarity in base layers 808, 810, and 812.

The embodiment of FIGS. 13-15 can be used in combination with the embodiment of FIGS. 2-10 or the embodiment of FIGS. 11A-11D.

Figure 16:
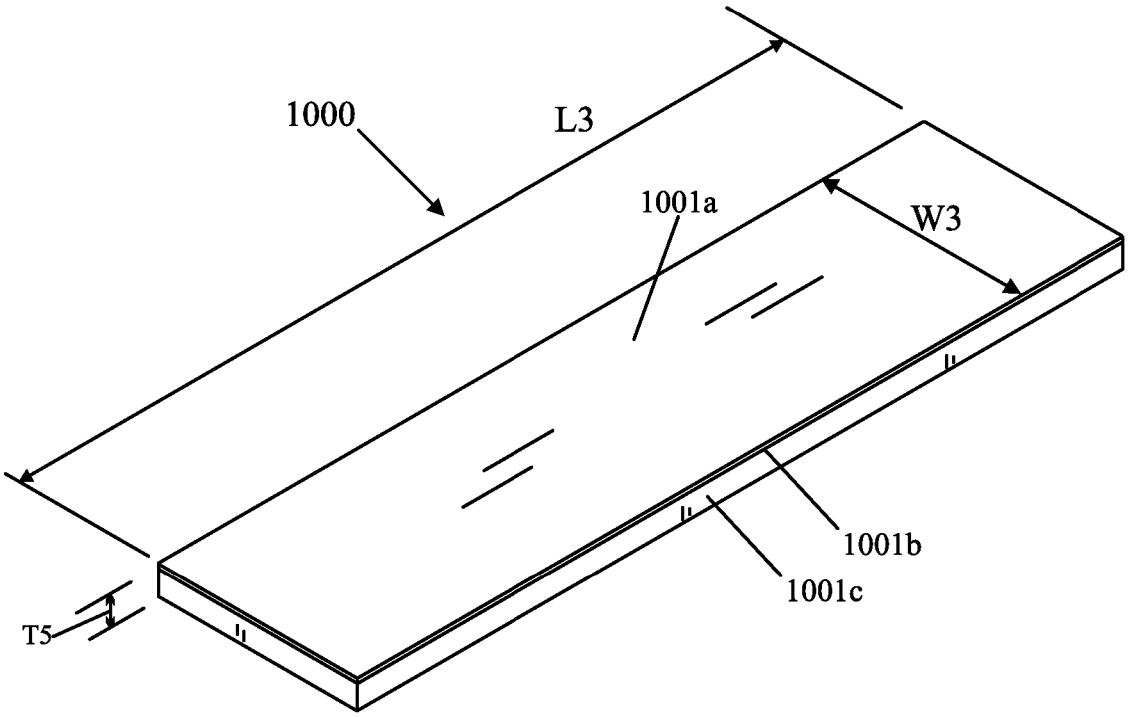
FIG. 16 shows a top, front, right perspective view of a piece to be used to create a floor plank in accordance with an embodiment of the present invention.

For example, FIG. 16 shows a top, front, right perspective view of a piece 1000 to be used to create a floor plank in accordance with another embodiment of the present invention. The piece 1000 may be a rectangular block or strip having a top surface 1001*a*. The piece 1000 may have a layer 1001*b* and a layer 1001*c*. The layer 1001*b* may include a wear layer or sublayer and a pattern (or design) layer or sublayer. The wear layer of the layer 1001*b* may be a thin transparent layer. The pattern (or design) layer of the layer 1001*b* may be a thin design layer, such as a synthetic wood grain design layer or a polyvinyl chloride synthetic wood grain design layer. The layer 1001*c* may also be called a base layer. The piece 1000 may have a length L3, which may be any length, with some typical lengths for L3 being three or four feet. The piece 1000 may have a width W3, which may be any width, with some typical widths for W3 being three, four, six, eight, nine, or twelve inches. The piece 1000 may have a depth of T5, which may be between 1.5 and 8.0 millimeters. In at least one embodiment, the thicker T5 is the better the performance. However, a thicker T5 may be too expensive for resellers and end-users to afford. For some purposes, making T5 1.5 millimeters may be too thin to bevel. For that reason for some embodiments, the thickness T5 should be thicker than 2.0 millimeters or in some cases thicker than 3.0 millimeters.

In at least one embodiment the base layer 1001*c* may be comprised substantially or entirely of a magnetic-powdered layer, and an iron-powdered layer. In at least one embodiment of the present invention, the order does not matter, i.e. either the magnetic layer or the iron-powdered layer may be closer to the surface 1001*a* then the other layer.

The layer 1001*c* may have more than one magnetic base layer, similar to or identical to base layers 808, 810 and 812 shown in FIGS. 13 and 14. In at least one embodiment, the piece 1000 of FIG. 16 can have a magnetic base layer or layers, similar to or identical to one or more of magnetic base layers 808, 810, and 812 shown in FIGS. 13 and 14 as part of the layer 1001*c*.

In at least one embodiment, a magnetic layer, iron layer, or a layer which is non magnetic and contains no iron and no ilmenite (such as a polyvinyl chloride layer, calcium carbonate layer, DINP/DOP layer, or some combination of these materials) can be added onto layer 1001*c* of FIG. 16. In another embodiment, an ilmenite layer, or an anti-slip film layer can be added onto layer 1001*c*.

Figure 17:
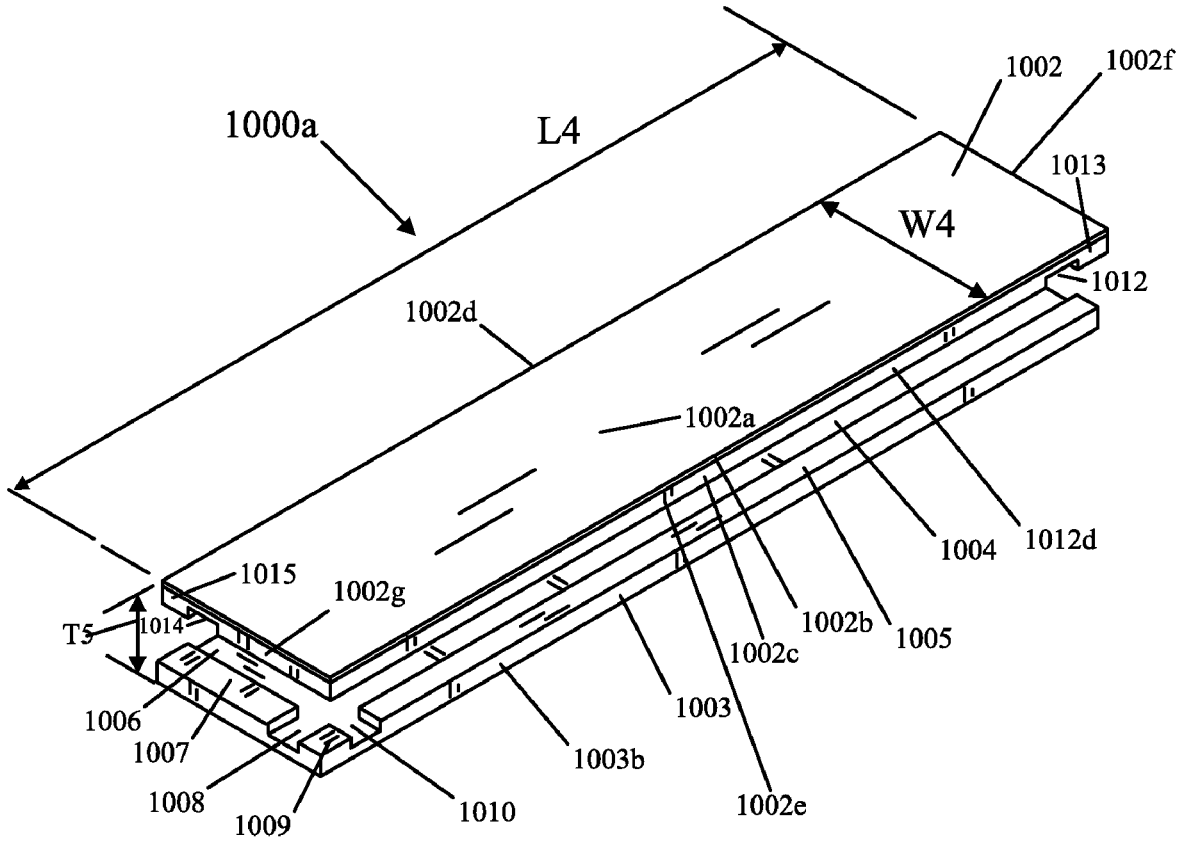
FIG. 17 shows a top, front, right perspective view of a floor plank, which has been created from the piece of FIG. 16, in accordance with an embodiment of the present invention.

Then, similar to the manner in which piece 100 of FIG. 2 is modified into plank 100*a* of FIG. 3, a wearlayer is removed from the piece 1000 of FIG. 16 to create a plank 1000*a* shown in FIG. 17.

Figure 18:
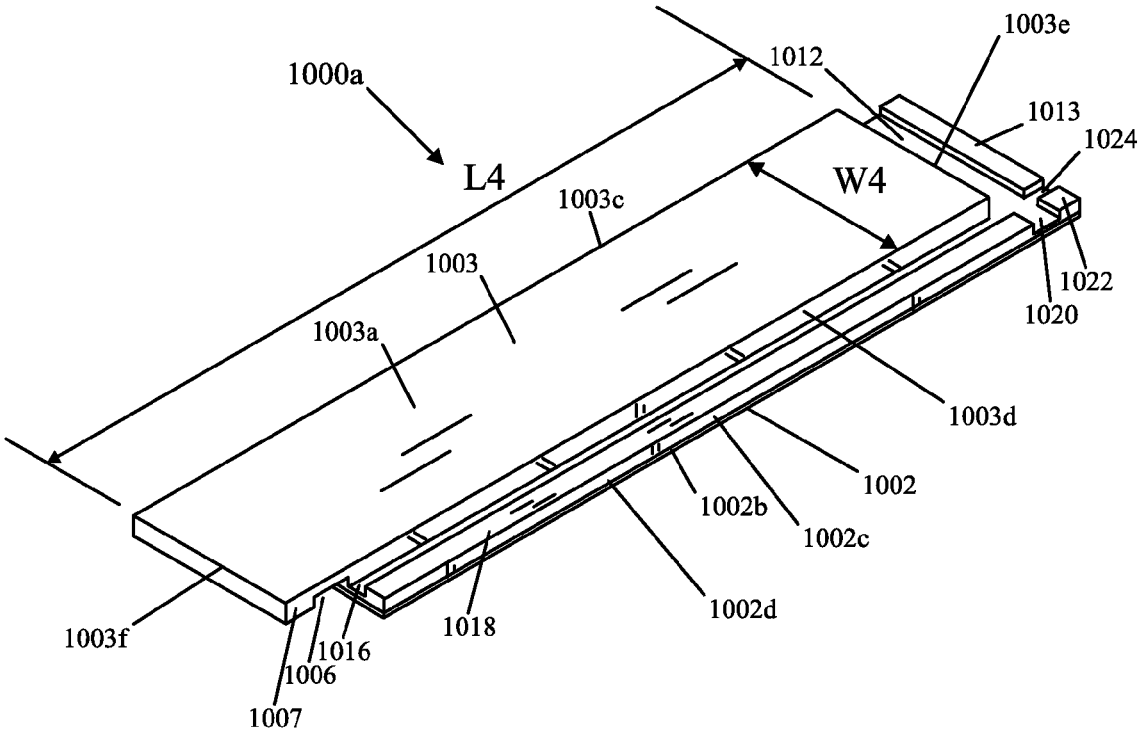
FIG. 18 shows a bottom, front, left perspective view of the floor plank of FIG. 17.

FIG. 17 shows a top, front, right perspective view of a floor plank 1000*a*, created from the piece 1000 in accordance with an embodiment of the present invention. FIG. 18 shows a bottom, front, left perspective view of the floor plank 1000*a*. The floor plank 1000*a* may be created from the piece 1000 of FIG. 16, by cutting, beveling, etching, sculpting, carving, or chiseling out or otherwise removing portions of the piece 1000, similar to the floor plank 100*a* formed from the piece 100.

The floor plank 1000*a* shown in FIG. 17, formed from the piece 1000, includes a top portion 1002 and a bottom portion 1003. The top portion 1002 may have a wood veneer surface 1002*a* or synthetic plastic surface for a floor. The surface 1002*a* may be printed plastic. The top portion 1002 may include a layer 1002*b* and a layer 1002*c*. The layer 1002*b* may include a wear layer and a pattern or design layer. The layer 1002*b* has a length L4, which can be any length, but which depends on how much it is desired to cut off from the piece 1000 to reduce L3 in FIG. 16. A larger contact area is decided by the width of the areas which are cut off. If we cut more, the contact areas will be larger, but L4 and W4 are typically meant to be shorter and narrower. The layer 1002*b* has a width W4 which is less than the width W3 in FIG. 16. The layer 1002*b* is a modified version of the layer 1001*b*, with an L-shaped section of the layer 1001*b* removed by cutting, beveling, etching, sculpting, carving, or chiseling out or otherwise removing the L-shaped section of the layer 1001*b* to form the layer 1002*b*. The combination of the layer 1002*c* and the portion 1003 shown in FIG. 17, is a modified version of the layer 1001*c* of the piece 1000 shown in FIG. 16, with various portions of the layer 1001*c* removed by cutting, beveling, etching, sculpting, carving, or chiseling out or otherwise removing various portions, such as L-shaped portions, of the layer 1001*c* to form the layer 1002*c* and portion 1003.

The layer 1002*c* and the portion 1003 shown in FIG. 17 may substantially be made of a combination of a magnetics layer and an iron/ilmenite layer. In FIG. 17, the channel 1004 may be a negative (south) magnetic pole while the rail 1015 may be a positive (north) magnetic pole. A plank identical to plank 1000*a*, can have its rail (having a positive or north magnetic pole and corresponding to rail 1015) inserted into the channel 1004 (having a negative or south magnetic pole) in order to magnetically connect two planks, each identical to plank 1000*a*.

The floor plank 1000*a* may further include slots or channels 1004, 1006, 1008, and 1010 shown in FIG. 17, and slots or channels 1012, 1016, 1020, and 1024 shown in FIG. 18, which may be formed by cutting, beveling, etching, sculpting, carving, or chiseling out or otherwise removing various portions, such as for example L-shaped portions, of the piece 1000 of FIG. 16 to form the floor plank 1000*a* of FIG. 17. The floor plank 1000*a* may further include rails or protrusions 1005, 1007, 1009, 1013, and 1015 shown in FIG. 17, and rails or protrusions 1018 and 1022 shown in FIG. 18, which may be formed by cutting, beveling, etching, sculpting, carving, or chiseling out or otherwise removing various portions of the piece 1000 of FIG. 16 to form the floor plank 1000*a* of FIG. 17.

The floor plank 1000*a* may include a base layer which may be comprised of layer 1002*c* and portion 1003. The base layer may include a balance layer and a leveling layer. Typically, in at least one embodiment, only a base layer comes out of a calendering machine or extruder machine. The base layer is then immediately laminated, first with a pattern film and then with a wear layer, or with the pattern film and the wear layer at the same time, to form the piece 1000 shown in FIG. 16. To form the piece 1000, the combination of the wear layer and the pattern film or design layer 1001*b* is laiminated to the base layer 1001*c*, to form a uniform rectangular block or strip in which layers 1001*b* and 1001*c* are aligned and neither of the layers 1001*b* and 1001*c* extend substantially beyond the other layer.

The wear layer is transparent, is part of the layer 1002*b*, and is on the surface 1002*a* of the floor plank 1000*a* shown in FIG. 17. The pattern layer lies underneath the wear layer or surface 1002*a*, and is also part of the layer 1002*b*. The pattern layer typically takes up a relatively small part or cross section versus the cross section taken up by the layer 1002*c* and the portion 1003. As examples, the thickness of the pattern layer (of layer 1002*b*) or film may be about 0.07 millimeters, while the typically transparent wear layer (of layer 1002*b* in FIG. 17) or surface 1002*a* can be from 0.03 millimeters to 1.2 millimeters. A wear layer in the range of 0.03 millimeters to 0.30 millimeters wear layers usually is used with an overall tile/plank 1000*a* thickness T5, shown in FIG. 17, of between 1.5 millimeters and 8.0 millimeters, and typically the thicker T5 is the better the performance. The overall plank thickness of plank 1000*a* shown in FIG. 17 is equal to the thickness T3 of the unmodified piece 1000 shown in FIG. 16. A wear layer in the range of 0.35 millimeters to 1.2 millimeters typically would be used with an overall tile/plank 1000*a* thickness T5 above 2.5 millimeters.

Typically a cutting die would be used to form the edges of the piece 1000 which may be in the form of a conventional known plank or tile. A bevel machine or some other type of machine can be used to cut, bevel, etch, sculpt, carve, chisel out or otherwise form the slots or channels such as, slots or channels 1004, 1006, 1008, 1010, shown in FIG. 17, and slots or channels 1012, 1016, 1020, and 1024 shown in FIG. 18 or to form the rails or protrusions 1005, 1007, 1009, 1013, and 1015 shown in FIG. 17, and rails or protrusions 1018 and 1022 shown in FIG. 18, in order to modify the piece 1000 of FIG. 16 into the floor plank 1000*a* of FIG. 17.

Figure 19:
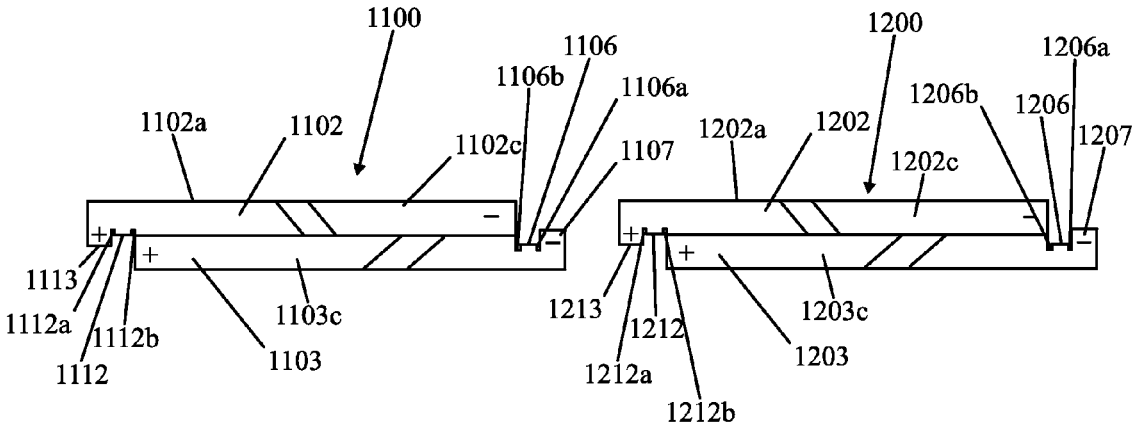
FIG. 19 shows a left side view of two floor planks in accordance with another embodiment of the present invention, with the two floor planks shows separated from each other.
Figure 20:
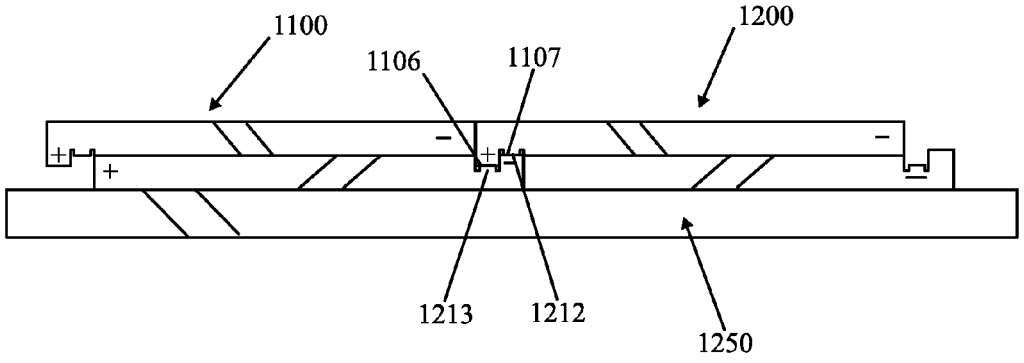
FIG. 20 shows a left side view of the two floor planks of FIG. 19, with the two floor planks shows connected together.

FIG. 19 shows a left side view of two floor planks, floor plank 1100 and floor plank 1200 in accordance with another embodiment of the present invention, with the two floor planks 1100 and 1200 shows separated from each other. FIG. 20 shows a left side view of the two floor planks, 1100 and 1200 of FIG. 19, with the two floor planks 1100 and 1200 shown connected together.

Each of the floor planks 1100 and 1200 may be identical to or substantially the same as the floor plank 1000*a* of FIG. 18, with some optional additions or modifications as will be described. The floor planks 1100 and 1200 may include top portions 1102 and 1202, and bottom portions 1103 and 1203, respectively, as shown by FIG. 19. The floor plank 1100 may include slots or channels 1106 and 1112; and the floor plank 1200 may include slots or channels 1206 and 1212, which may be similar to or identical to slots or channels 1006 and 1012 shown in FIG. 18 for floor plank 1000*a*. The floor plank 1100 may include rails 1107 and 1113 which may be similar to or identical to rails 1007 and 1013 shown in FIG. 18 for floor plank 1000*a*; and the floor plank 1200 may include slots or channels 1206 and 1212, which may be similar to or identical to slots or channels 1006 and 1012 shown in FIG. 18 for floor plank 1000*a*.

The floor plank 1100 may also include grooves or further channels 1106*a-b* and 1112*a-b* in FIG. 19 and grooves; and the floor plank 1200 may also include grooves or further channels 1206*a-b* and 1212*a-b*. The further grooves or channels 1106*a-b* (or 1206*a-b*) and 1112*a-b* (or 1212*a-b*) may be added to the plank 1000*a* to form a modified version of plank 1000*a*. The further grooves or channels 1106*a-b* (or 1206*a-b*) and 1112*a-b* (or 1212*a-b*) are used to allow excessive adhesive to flow into the further grooves or channels 1106*a-b* (or 1206*a-b*) and 1112*a-b* (or 1212*a-b*). The further grooves or channels 1106*a-b* (or 1206*a-b*) and 1112*a-b* (or 1212*a-b*) are optional and depend on what kind of adhesive or cement is used, may or may not be useful or needed. When magnetic material is used to hold adjacent floor planks, the further grooves or channels 1106*a-b* (or 1206*a-b*) and 1112*a-b* (or 1212*a-b*) may not be necessary, since adhesive may not be necessary, since magnetic material may sufficiently hold adjacent floor planks (similar or identical to floor plank 1100) together.

There are "+" signs and "−" signs shown on the planks 1100 and 1200 in FIGS. 19 and 20, which are used to represent the positive (north) and negative (south) poles of a magnet and/or magnetic field for materials in the planks 1100 and 1200. The planks 1100 and 1200 are placed on a floor surface 1250, as shown in FIG. 20, so that the rail 1213 (having a positive or north pole) is placed inside the channel 1106 (having a negative or south pole), while simultaneously the rail 1107 (having a negative or south pole) is placed in the channel 1212 (having a positive or north pole). In this manner the planks 1100 and 1200 can be connected or adhered magnetically together.

In accordance with one embodiment of the present invention, a piece, such as 1000 in FIG. 16, having a magnetic layer, which may be part of portion 1001*c*, and an iron/ilmenite layer, which may be part of portion 1001*c*, can be cut or punched into a plank 1000*a* having a shape shown in FIG. 17, which may have an L-shaped channel (including channels 1006, and 1004. A plurality of planks, similar to or identical to plank 1000*a* can be connected together with appropriate rails inserted into corresponding channels. After cutting, beveling, etching, sculpting, carving or chiseling the piece 1000 of FIG. 16, the plank 1000*a* (and any identical planks made) will have two sides that are magnetic and another two sides with iron/ilmenite. In at least one embodiment, referring to FIG. 17, the sections, channels, rails, or portions 1012*d*, 1002*g*, 1013, and 1012 may be made entirely or substantially of ilmenite or iron, and the sections, channels, rails, or portions 1003, 1010, 1006, and 1007 may be made entirely or substantially of a magnetic material. However, it can be reversed such that the sections, channels, rails, or portions 1012*d*, 1002*g*, 1013, and 1012 may be made entirely or substantially of a magnetic material, and the sections, channels, rails, or portions 1003, 1010, 1006, and 1007 may be made entirely or substantially of ilmenite or iron. In this manner two planks (i.e. identical planks 1000*a*) can be attracted to each other.

In at least one embodiment a sign may be embossed on the bottom of a plank to show where magnetic material. For example, magnetic material may be used on the bottom of floor plank 501 shown in FIG. 11C, such as on the bottom of devices 510, such as device 510*a-b*. If the bottom of devices 510, such as devices 510*a* and 510*b*, are magnetic, the bottom of devices 510*a-b*, shown in FIG. 11C may be marked with a few "+" signs or "–" signs depending on whether they are closer to right side 506*a* of plank 501 shown in FIG. 11C or the left side 506*d* of plank 501 shown in FIG. 11B. The "+" or "–" signs may be on the hexagon bottom parts of devices 510, such as on devices 510*a* and 510*b*. Thus side 506*a* may have a positive magnetic polarity while side 506*d* may have a negative magnetic polarity.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method comprising placing a first floor plank on a subfloor;

wherein the first floor plank has a length, a width, and a thickness; and wherein the first floor plank is placed on the subfloor so that the thickness of the first floor plank is substantially perpendicular to the subfloor, and the length and the width of the first floor plank are substantially parallel to the subfloor;

placing a second floor plank on the subfloor;

wherein the second floor plank has a length, a width, and a thickness; and wherein the second floor plank is placed on the subfloor so that the thickness of the second floor plank is substantially perpendicular to the subfloor, and the length and the width of the second floor plank are substantially parallel to the subfloor;

wherein the first floor plank is comprised of a wear layer; a pattern film; and a a magnetic base layer, wherein the length and the width of the first floor plank are substantially larger than the thickness of the first floor plank;

wherein the magnetic base layer of the first floor plank has a magnetic field which is in a direction substantially parallel to a plane defined by the length and the width of the first floor plank, and wherein the direction of the magnetic field is substantially perpendicular to the thickness of the first floor plank;

wherein the second floor plank is comprised of a wear layer; a pattern film; and a a magnetic base layer, wherein the length and the width of the second floor plank are substantially larger than the thickness of the second floor plank;

wherein the magnetic base layer of the second floor plank has a magnetic field which is in a direction substantially parallel to a plane defined by the length and the width of the second floor plank, and wherein the direction of the magnetic field of the second floor plank is substantially perpendicular to the thickness of the second floor plank;

wherein the first floor plank and the second floor plank are placed on the subfloor so that the first floor plank and the second floor plank are adjacent one another and so that a first magnetic pole of the magnetic base layer of the first floor plank is placed between a first portion of the second floor plank and a second portion of the second floor plank;

wherein the first portion of the second floor plank has a second magnetic pole which is opposite in polarity to the first magnetic pole of the magnetic base layer of the first floor plank; and wherein the second portion of the second floor plank has a third magnetic pole which is opposite in polarity to the first magnetic pole of the magnetic base layer of the first floor plank;

wherein the first magnetic pole of the first floor plank is placed between the first portion of the second floor plank and the second portion of the second floor plank so that the first magnetic pole is attracted to the second magnetic pole in a first direction, and is simultaneously is attracted to the third magnetic pole in a second direction, which is opposite the first direction to thereby magnetically connect the first floor plank and the second floor plank.

2. The method of claim 1 wherein the first floor plank includes an anti-slip polyvinyl chloride layer; and the second floor plank includes an anti-slip polyvinyl chloride layer.

3. The method of claim 1 wherein the first floor plank includes an anti-slip polyurethane layer; and the second floor plank includes an anti-slip polyurethane layer.

4. The method of claim 1 wherein the pattern film of the first floor plank is arranged so that it is between the wear layer of the first floor plank and the magnetic base layer of the first floor plank;

and the pattern film of the second floor plank is arranged so that it is between the wear layer of the second floor plank and the magnetic base layer of the second floor plank.

5. The method of claim 1 wherein the magnetic layer of the first floor plank has a magnetic north pole running along the length of the first floor plank at a first end of the first floor plank, and the magnetic layer of the first floor plank has a magnetic south pole running along the length of the first floor plank at a second end of the first floor plank, which is opposite the first end of the first floor plank; and the magnetic layer of the second floor plank has a magnetic north pole running along the length of the second floor plank at a first end of the second floor plank, and the magnetic layer of the second floor plank has a magnetic south pole running along the length of the second floor plank at a second end of the second floor plank, which is opposite the first end of the second floor plank.

6. The method of claim 1 wherein the first floor plank includes a plurality of channels and rails, and the second floor plank includes a plurality of channels and rails;

wherein each channel of the first floor plank is adapted to tightly receive a corresponding rail of the second floor plank; and wherein each rail of the first floor plank is adapted to tightly fit into a corresponding channel of the second floor plank;

wherein each rail of the first floor plank has a first magnetic polarity;

wherein each channel of the first floor plank has a bottom portion, and opposing first and second wall portions, which substantially form a U-shape, with the bottom portion of each channel of the first floor plank being the bottom of the U-shape of each channel of the first floor plank, and the first and the second wall portions of each channel of the first floor plank being substantially perpendicular to each other and separated by the bottom portion of each channel of the first floor plank;

wherein the opposing first and second wall portions of each channel of the first floor plank have a second magnetic polarity;

wherein each rail of the second floor plank has a first magnetic polarity;

wherein each channel of the second floor plank has a bottom portion, and opposing first and second wall portions, which substantially form a U-shape, with the bottom portion of each channel of the second floor plank being the bottom of the U-shape of each channel of the second floor plank, and the first and the second wall portions of each channel of the second floor plank being substantially perpendicular to each other and separated by the bottom portion of each channel of the second floor plank;

wherein the opposing first and second wall portions of each channel of the second floor plank have a second magnetic polarity;

wherein each rail of the first floor plank is configured to be placed between first and second wall portions of a corresponding channel of the plurality of channels of the second floor plank so that the first magnetic polarity of each rail of the first floor plank is attracted to the second magnetic polarity of the first wall portion of the corresponding channel of the plurality of channels of the second floor plank in a third direction, and is simultaneously attracted to the second magnetic polarity of the second wall portion of the corresponding channel of the plurality of channels of the second floor plank in a fourth direction, which is opposite the third direction, to thereby magnetically connect the first floor plank and the second floor plank; and wherein each rail of the second floor plank is configured to be placed between first and second wall portions of a corresponding channel of the plurality of channels of the first floor plank so that the first magnetic polarity of each rail of the second floor plank is attracted to the second magnetic polarity of the first wall portion of the corresponding channel of the plurality of channels of the first floor plank in a fifth direction, and is simultaneously attracted to the second magnetic polarity of the second wall portion of the corresponding channel of the plurality of channels of the first floor plank in a sixth direction, which is opposite the fifth direction, to thereby magnetically connect the first floor plank and the second floor plank.

7. The method of claim 1 wherein the first floor plank includes a layer of a plurality of protruding devices; and the second floor plank includes a layer of a plurality of protruding devices.

8. The method of claim 7 wherein each of the plurality of protruding devices of the first floor plank has a hexagonal surface; and wherein each of the plurality of protruding devices of the second floor plank has a hexagonal surface.

9. A method comprising laminating a first layer of a first material to a first base material to form a first floor plank;

laminating a second layer of a second material to a second base material to form a second floor plank;

after the first layer has been laminated to the first base material to form the first floor plank, using a magnetizer machine to form a first magnetic polarity in the first layer;

after the second layer has been laminated to the second base material to form the second floor plank, using a magnetizer machine to form a second magnetic polarity in the second layer;

placing the first floor plank on a subfloor;

wherein the first floor plank has a length, a width, and a thickness; and wherein the first floor plank is placed on the subfloor so that the thickness of the first floor plank is substantially perpendicular to the subfloor, and the length and the width of the first floor plank are substantially parallel to the subfloor;

placing the second floor plank on the subfloor;

wherein the second floor plank has a length, a width, and a thickness; and wherein the second floor plank is placed on the subfloor so that the thickness of the second floor plank is substantially perpendicular to the subfloor, and the length and the width of the second floor plank are substantially parallel to the subfloor;

wherein the first floor plank is comprised of a wear layer; a pattern film; and a the first layer;

wherein the length and the width of the first floor plank are substantially larger than the thickness of the first floor plank;

wherein the first magnetic polarity is in a direction substantially parallel to a plane defined by the length and the width of the first floor plank, and wherein the direction of the first magnetic polarity is substantially perpendicular to the thickness of the first floor plank;

wherein the second floor plank is comprised of a wear layer; a pattern film; and the second layer, wherein the length and the width of the second floor plank are substantially larger than the thickness of the second floor plank;

wherein the second magnetic polarity is in a direction substantially parallel to a plane defined by the length and the width of the second floor plank, and wherein the direction of the second magnetic polarity is substantially perpendicular to the thickness of the second floor plank; and wherein the first floor plank and the second floor plank are placed on the subfloor so that the first floor plank and the second floor plank are adjacent one another and so that the first magnetic polarity of the first floor plank is attracted to the second magnetic polarity of the second floor plank to thereby magnetically connect the first floor plank and the second floor plank.

10. The method of claim 1 further comprising laminating a first layer of a first material to a first base material to form the first floor plank prior to placing the first floor plank on the subfloor;

laminating a second layer of a second material to a second base material form the second floor plank prior to placing the second floor plank on the subfloor;

after the first layer has been laminated to the first base material to form the first floor plank, using a magnetizer machine to form a first magnetic polarity in the first layer, to change the first layer into the magnetic layer of the first floor plank; and after the second layer has been laminated to the second base material to form the second floor plank, using a magnetizer machine to form a second magnetic polarity in the second layer to change the second layer into the magnetic layer of the second floor plank.

11. The method of claim 1 wherein the first floor plank further includes a backing layer which has a first abradant material such that placing the first floor plank on the subfloor causes the first abradant material to come in contact with the subfloor; and the first floor plank further includes a backing layer which has a second abradant material such that placing the second floor plank on the subfloor causes the second abradant material to come in contact with the subfloor.

12. The method of claim 11 wherein first abradant material includes a plurality of abradant particles;

and the second abradant material includes a plurality of abradant particles.

* * * * *